US005560425A

United States Patent [19]

Sugawara et al.

[11] Patent Number: 5,560,425

[45] Date of Patent: Oct. 1, 1996

[54] MULTI-FLOW TYPE HEAT EXCHANGER

[75] Inventors: Masatsugu Sugawara; Kazuhito Baba; Toshiaki Yamamoto; Tsutomu Sunaga, all of Tokyo, Japan

[73] Assignee: Calsonic Corporation, Tokyo, Japan

[21] Appl. No.: 448,874

[22] Filed: May 24, 1995

Related U.S. Application Data

[63] Continuation of Ser. No. 977,041, Nov. 16, 1992, which is a continuation of Ser. No. 703,607, May 21, 1991, abandoned, which is a continuation of Ser. No. 392,724, Aug. 11, 1989, abandoned.

[30] Foreign Application Priority Data

| | | | |
|---|---|---|---|
| Aug. 12, 1988 | [JP] | Japan | 63-106782 |
| Aug. 12, 1988 | [JP] | Japan | 63-106783 |
| Aug. 12, 1988 | [JP] | Japan | 63-106784 |
| Aug. 12, 1988 | [JP] | Japan | 63-106785 |

[51] Int. Cl.[6] ..... F28D 1/053; F28F 1/42; F28F 9/04

[52] U.S. Cl. ..... 165/148; 165/153; 165/173; 165/179; 165/170

[58] Field of Search ..... 165/151, 153, 165/173, 67, 177, 179, 181, 170, 166; 29/890.043, 890.045, 890.053

[56] References Cited

U.S. PATENT DOCUMENTS

| | | | |
|---|---|---|---|
| 1,191,681 | 7/1916 | Feldkamp | 165/148 |
| 2,221,934 | 11/1940 | Ferris | 29/890.043 |
| 2,286,398 | 6/1942 | Young | 180/68.4 |
| 2,360,123 | 10/1944 | Gerstung et al. | 165/166 |
| 3,757,856 | 9/1973 | Kun | 165/166 |
| 4,134,195 | 1/1979 | Jacobsen et al. | 165/153 X |
| 4,600,053 | 7/1986 | Patel et al. | 165/170 |
| 4,688,631 | 8/1987 | Peze et al. | 165/166 |
| 4,730,669 | 3/1988 | Beasley et al. | 165/151 |
| 4,800,954 | 1/1989 | Noguchi et al. | 165/153 |
| 4,998,580 | 3/1991 | Guntly et al. | 165/152 |
| 5,056,704 | 10/1991 | Martin et al. | 228/183 X |

FOREIGN PATENT DOCUMENTS

| | | | |
|---|---|---|---|
| 224144 | 10/1958 | Australia . | |
| 915093 | 10/1946 | France . | |
| 1521595 | 3/1968 | France . | |
| 2010517 | 2/1970 | France | 165/176 |
| 2648407 | 4/1978 | Germany . | |
| 3527666 | 1/1987 | Germany . | |
| 188070 | 5/1956 | Japan . | |
| 61-295494 | 12/1986 | Japan . | |
| 62-5098 | 1/1987 | Japan . | |
| 62-39182 | 3/1987 | Japan . | |
| 62-52785 | 4/1987 | Japan . | |
| 62-110017 | 7/1987 | Japan . | |
| 62-180277 | 11/1987 | Japan . | |
| 34489 | 2/1988 | Japan | 165/179 |
| 63-97082 | 6/1988 | Japan . | |
| 63-109890 | 7/1988 | Japan . | |
| 63-142585 | 9/1988 | Japan . | |
| 63-142586 | 9/1988 | Japan . | |
| 63-167090 | 10/1988 | Japan . | |
| 528297 | 10/1940 | United Kingdom . | |
| 1403063 | 8/1975 | United Kingdom . | |
| 1463047 | 2/1977 | United Kingdom . | |
| 2090651 | 7/1982 | United Kingdom . | |
| 2197449 | 5/1988 | United Kingdom . | |

*Primary Examiner*—Leonard R. Leo
*Attorney, Agent, or Firm*—Foley & Lardner

[57] ABSTRACT

A heat exchanger of the multi-flow type is provided with baffle members which are adapted to impart a zigzagging flow to the heat-exchange fluid in motion inside a flat tube and define, in conjunction with the inner wall of the flat tube, a flow path of a cross-sectional area having an equivalent diameter in the range of 0.4 to 1.5 mm. This heat exchanger excels in heat exchange ability and in facility of manufacture and assemblage.

25 Claims, 19 Drawing Sheets

MULTI-FLOW TYPE HEAT EXCHANGER

This application is a continuation of application Ser. No. 07/977,041, filed Nov. 16, 1992, which is a continuation of application Ser. No. 07/703,607, filed May 21, 1991, now abandoned, which is a continuation of application Ser. No. 07/392,724, filed Aug. 11, 1989, now abandoned.

BACKGROUND OF THE INVENTION

1. Field of the Invention

This invention relates to improvements in and concerning a multi-flow type heat exchanger to be incorporated in an automobile air conditioner.

2. Description of the Prior Art

Among the heat exchanger recently proposed for use as in condensers of automobile air conditioners are included those of the multi-flow type which are configured as illustrated in FIG. 34 (as disclosed in U.S. Pat. No. 4,615,385 and Japanese Patent Application Disclosure SHO 62(1987)-175, 588, for example).

The heat exchanger of this multi-flow type is provided with a pair of header pipes 1, 2 separated by a prescribed length e from each other and disposed parallelly to each other. An inlet tube 3 for introducing a heat-exchanger fluid such as a refrigerant is fitted to the inlet side header pipe 1 and an outlet tube 4 for discharging the heat-exchanger fluid is fitted to the other outlet side header pipe 2. Between the two header pipes 1, 2, a multiplicity of flat tubes 5 are installed so as to intercommunicate these two header pipes 1, 2. Thus, the heat-exchanger fluid flowing in through the inlet side header pipe 1 advances in the form of a plurality of parallel flows and flows into the outlet side header pipe 2. On the opposed side surfaces of the two header pipes 1, 2, bulged parts 6 of the shape of a dome are formed as illustrated in FIG. 35 for the purpose of enhancing the heat exchangers' strength to resist pressure.

In FIGS. 34 and 35, the reference numeral "7" denotes a corrugated fin for transfer of heat, the reference numerals "8 and 9" denote blank covers, and the reference numeral "10" denotes a reinforcing plate.

In the flat tube 5, an inner fin 11 whose cross section taken perpendicularly to the axis thereof is corrugated with a prescribed pitch p as illustrated in FIG. 36, is inserted and fixed in place. The inner fin 11 serves the purpose of partitioning the flow path r of the flat tube 5 and giving rise to a plurality of independent small flow paths 12 therein.

In this heat exchanger H of the multi-flow type, therefore, the heat-exchanger fluid which flows in the inlet side header pipe 1 advances collectively in the form of a plurality of parallel flows in the direction of the outlet side header pipe 2 and, at the same time, advances in the form of parallel flows severally inside the small flow paths 12.

The heat exchanger H of the multi-flow type, for the sake of enhancing the capacity thereof for exchange of heat, has the small flow paths 12 each so adapted that the equivalent diameter (the diameter of a flow path having a circular cross-sectional area equaling the cross-sectional area of the small flow path) thereof has a predescribed value. Specifically, in consideration of the pressure drop occurring in the flowing air, the resistance offered to the flow of the heat-exchanger fluid and the heat-exchange efficiency, the heat transfer area is adjusted to a prescribed value so as to heighten the whole heat exchange efficiency of the heat exchanger. There are heat exchangers which use the so-called serpenine tubes (flat tubes of an elliptical section extrusion molded so as to form a plurality of flow paths inside). The heat exchanger of the multi-flow type described above, as compared with the heat exchanger of the type using the serpentine tubes, has the merit high pressure-resisting capacity, small size, and light Weight ascribable to the formation of bulged parts 9 on the header pipes 1. 2 in addition to enjoying the advantages of small thickness of tube low resistance to the fluid in motion, and high capacity for exchange of heat.

The heat exchanger of the multi-flow type, however, is problematic in terms of performance and in terms of manufacture.

First as concerns the performance, the inner fin 11 is soldered in place within a furnace in such a manner as to define the flow paths 5 inside the flat tube 5 as illustrated in FIG. 36. The small flow paths 12 consequently formed herein extent straightly from the leading ends to the trailing ends thereof. The heat-exchanger fluid flows just straightly inside the flat tube 5 and has no possibility of being stirred while in motion therein. It is not inconceivable that the portion of the heat-exchanger fluid which flows along the central part of the cross section of the small flow paths 12 just advances through the interior of the flat tube 5. The heat-exchanger fluid does not wholly contribute to the action of exchange of heat.

The portions of the heat-exchanger fluid flowing inside the small flow paths 12 defined by the inner fin 11, while in motion between the header pipes 1, 2, are not intermingled with one another but simply advanced without being allowed to manifest the heat exchange ability to a sufficient extent.

In connection with this point, Japanese Patent Application Disclosure SHO 61(1986)-295,494 and Japanese Utility Model Application Disclosure SHO 62(1987)-39,182 disclose a corrugated inner fin so configured that the waves thereof are staggered by a prescribed pitch. This inner fin is capable of imparting a zigzagging flow to the heat-exchanger fluid and incapable of manifesting the heat exchange ability fully satisfactorily.

The heat exchanger of the multi-flow type is further problematic in terms of manufacture.

The inner fin 11 is soldered within the furnace in conjunction with all of the other component members of the heat exchanger including the flat tube 5. In this case, the step of applying flux to the ridge parts 11*a* of the inner fin 11 is required to precede the step of entering the component members of the heat exchanger in the furnace. In this step, however, since the inner fin 11 is corrugated as illustrated in FIG. 37, the flux adhering to the ridge parts 11*a* trickles down the sloped surfaces and collects in the groove parts 11*b*. As the result, the flux adheres in an insufficient amount to the surface of the ridge parts 11*a* which require the flux to be deposited most thickly and the work of soldering consequently becomes extremely difficult.

Further, the heat exchanger H of the multi-flow type, as disclosed in U.S. Pat. No. 4,651,816, is fixed in place by causing brackets 13 attached fast as by soldering to the header pipes 1, 2 to be bolted to the car body or to other heat exchanger such as, for example, the radiator in the engine cooling cycle. The brackets 13 are generally made of aluminum. After the mounting positions for the brackets which are variable with vehicles are corrected by the use of jigs, for example, the brackets are soldiered integrally within the heating furnace at the same time that the flat tubes 5 and the corrugated fins 7 are soldered or they are first soldered and then fixed in place as by the TIG welding.

Incidentally, when the fixation is effected by the work of soldering as described above, it is generally difficult to solder the brackets while maintaining the accuracy of the mounting positions. The TIG welding proves to be disadvantageous in terms of productivity and cost because the number of steps of process is large.

Japanese Utility Model Application Disclosure SHO 61(1986)-110,017 discloses a structure for fixing the heat exchanger in place without being welded. Since the heat exchanger in this disclosure has no use for the header pipes, the number of component parts is unduly large and the assembly of such component parts consumes much time and labor.

SUMMARY OF THE INVENTION

This invention, conceived in the urge to eliminate the disadvantages of the prior art described above, aims to provide a heat exchanger of the multi-flow type which allowed to give through stirring to the heat-exchanger fluid without entailing any appreciable increase in the resistance offered by the fluid paths and enabled to excel in heat exchange performance and in facility of manufacture and assemblage by providing flat tubes therein with baffle members adapted to impart a zigzagging flow to the heat-exchanger fluid and, at the same time, giving to the flow paths defined by the baffle members and the inner walls of the falt tubes a cross-sectional area having an equivalent diameter in the range of 0.4 to 1.5 mm.

DETAILED DESCRIPTION OF THE PREFERRED EMBODIMENT

Now, one embodiment of this invention will be described with reference to the accompanying drawings.

Figure 1:
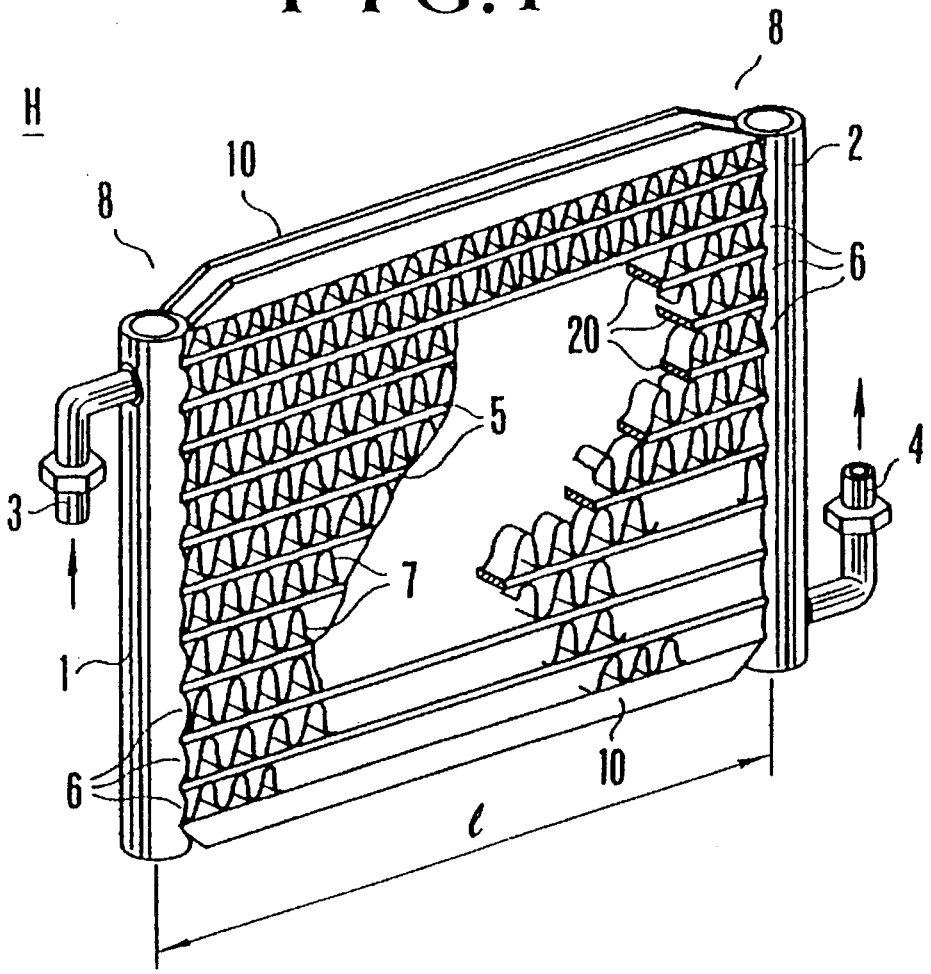
FIG. 1 is a partially cutaway perspective view illustrating an embodiment of this invention.
Figure 2:
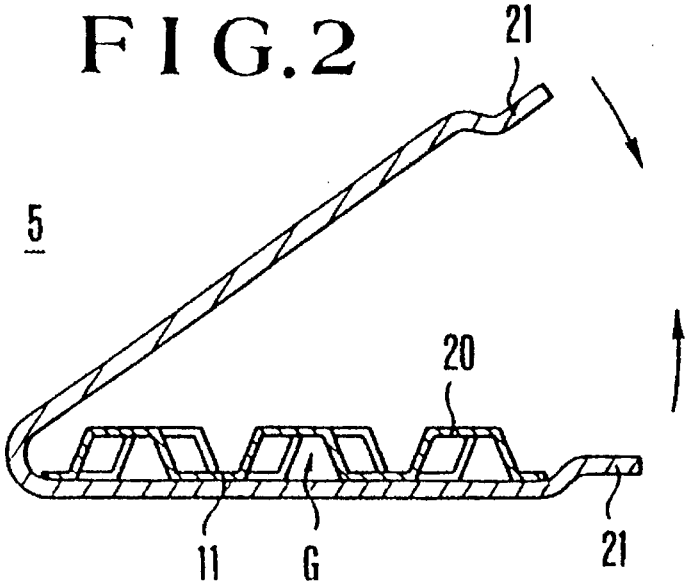
FIG. 2 is a cross section illustrating a flat tube in the embodiment in the process of shaping.
Figure 3:
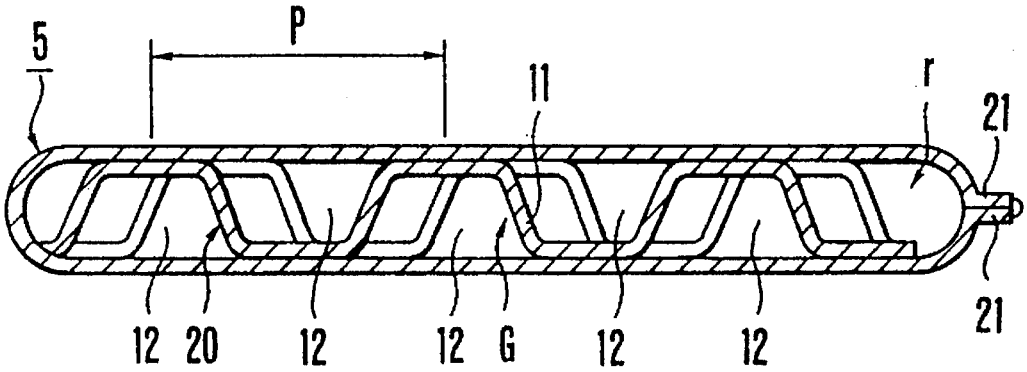
FIG. 3 is a cross section of the flat tube of the embodiment.
Figure 4:
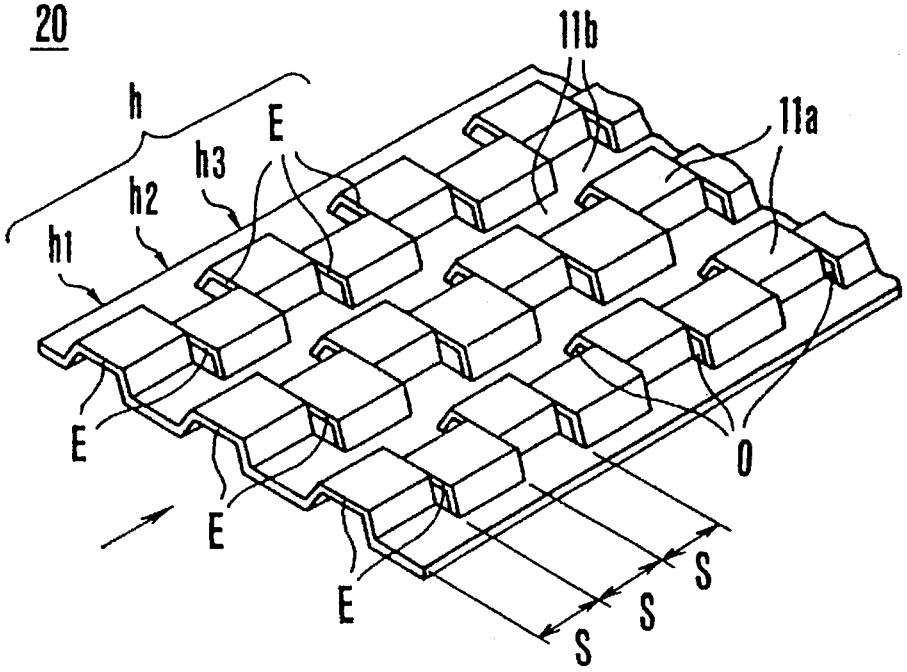
FIG. 4 is a perspective view of an inner fin.

FIG. 1 is a partially cutaway perspective view illustrating an embodiment of this invention, FIG. 2 is a cross section illustrating a flat tube of the embodiment in a state prior to shaping, FIG. 3 is a cross section illustrating the flat tube of the embodiment in a state after shaping, and FIG. 4 is a perspective view of the essential part of an inner fin. In these diagrams, the component parts which have equivalents in FIGS. 34 to 37 are denoted by the same reference numerals.

In the heat exchanger H of the multi-flow type, an inlet side header pipe 1 of a parallelly cross section fitted with an inlet tube 3 for admitting a heat-exchanger fluid in motion and an outlet side header pipe 2 of a parallelly cross section fitted with an outlet tube 4 for discharging the heat-exchanger fluid are separated by a prescribed length from each other and disposed annular to each other. Between these header pipes 1, 2, a multiplicity of flat tubes 5 are disposed so as to intercommunicate the header pipes. The arrangement of these component parts is similar to that illustrated in FIG. 34. These header pipes 1, 2 are made of aluminum and have a wall thickness of 1.5 mm.

First, the flat tube 5 will be explained.

The flat tube 5, as illustrated in FIG. 2, is produced by shaping a flat sheet material in a form having a flat U cross section perpendicular to the axis, deforming terminal flanges 21 of the sheet material in the direction of the arrow, and sitting in an inner fin 20 in the U-shaped sheet, then sticking the two flanges 21, 21, and between said inner fin 20 and the inside wall of said U-shaped sheet, and then welding them.

However, said weld stage can do it lump together as a whole, after assembling the beaer pipes 1, 2, the carrugated fin 7, and said U-shaped sheet with the inner fin 20. This coustructing method is similar another embodiment.

Now, the inner fin 20 disposed inside each of the flat tubes 5 and intended as a baffle member G whose function consists in baffling the flow of the refrigerant will be described.

This inner fin 20 is shaped in a form whose cross section perpendicular to the axis is corrugated at a prescribed pitch p as illustrated in FIGS. 3 and 4, so as to divide the flow path r inside the flat tube 5 into a plurality of small independent flow paths 12. The diameter of the fluid in motion inside these small flow paths 12 is so set that the equivalent diameter determined in connection with the pressure drop in the flowing air, the resistance to the flow of the heat-exchanger fluid, and the efficiency of exchange of heat will fall in a prescribed range of about 0.4 to 1.5 mm, preferably in the neighborhood of 0.7 mm.

Particularly when the corrugated parts h of the prescribed pitch p mentioned above are formed in the inner fin 20 of the present embodiment, the corrugated parts h are raised between slits placed parallelly at prescribed intervals s as staggered in the direction perpendicular to the direction of the flow of the heat-exchanger fluid (the direction of the arrow shown in FIG. 4) so that the edge surfaces E of the corrugated parts $h_2$ in the second stage are positioned at the centers of the corrugated parts $h_1$ in the first stage, the edge surfaces E of the corrugated parts $h_3$ in the third stage at the centers of the corrugated parts $h_2$ in the second stage, and so on.

Figure 37:
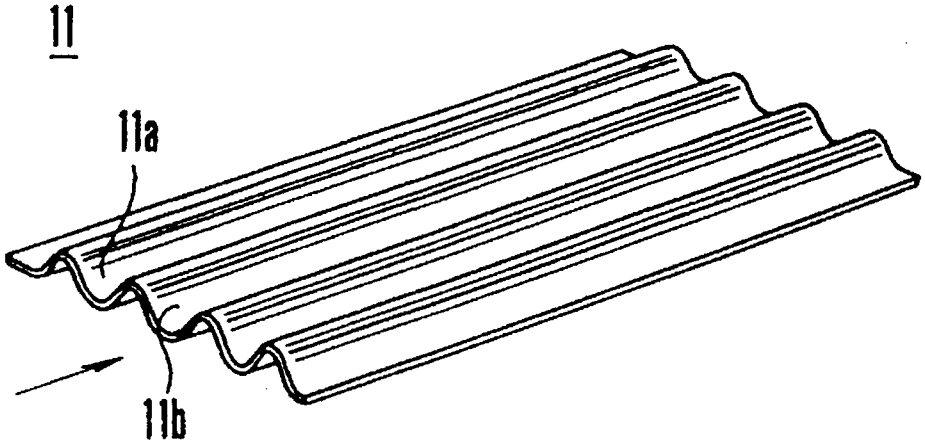
FIG.37 (PRIOR ART)
FIG. 37 is a perspective view of an inner fin of the conventional heat exchanger mentioned above.

In this case, the prescribed intervals s mentioned above may be equal to or different from one another. The ridges of these corrugated parts may be in the general shape of a rectangle as illustrated in FIG. 3 or in the natural shape of a wave as illustrated in FIG. 37.

In the arrangement described above, since the edge surfaces E manifest the edge effect (the heat exchange effect produced at the sharp edge portions resembling the edges of knifes is prominent as compared with the effect produced at any other portion; hence the designation "edge effect") and the edge surfaces E are present in a large number throughout the entire length of the flat tube 5, the exchange of heat between the heat-exchanger fluid and the air proceeds very efficiently and the ability of the heat exchanger as a whole to effect exchange of heat is heightened notably. Further, since these edge surfaces E are so distributed that the edge surfaces of the corrugated parts $h_2$ in the second stage are positioned at the centers of the corrugated parts $h_1$ in the first stage, the portions of the heat-exchanger fluid which have flowed down the small flow paths 12 formed by the corrugated parts $h_1$ of the first stage collide against and stirred by the edge surfaces E of the corrugated parts $h_2$ of the second stage. Owing to the effect of this agitation, the exchange of heat is carried out very efficiently and the ability of the heat exchanger as a whole to effect exchange of heat is enhanced to notable extent.

Figure 5:
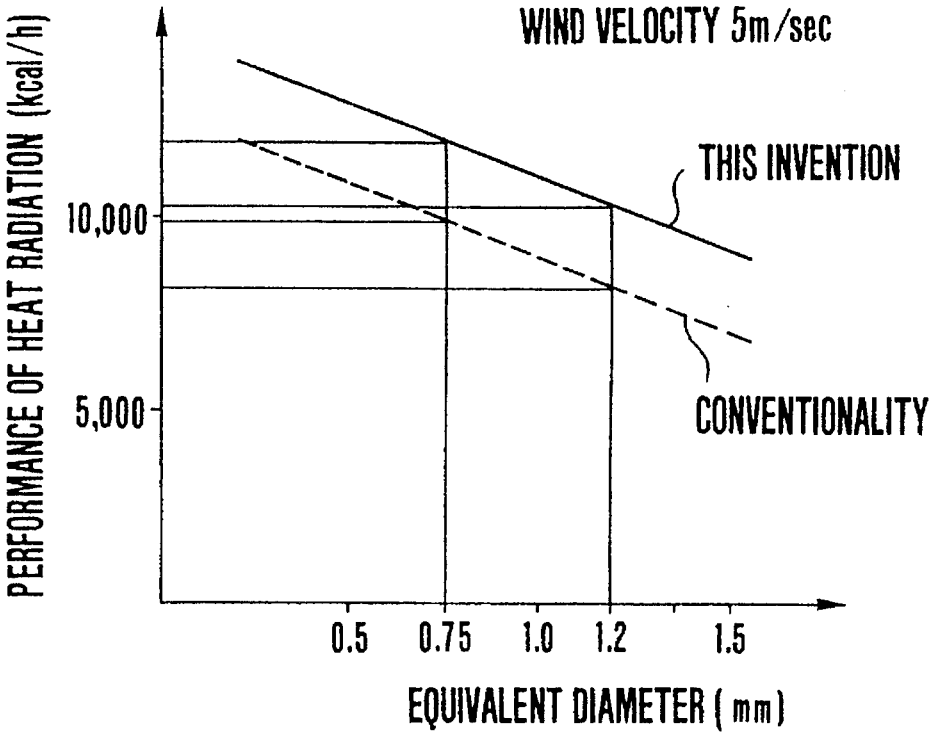
FIG. 5 and FIG. 6 are graphs showing the results of tests performed on the embodiment.

When the heat exchanger of the present embodiment was tested for performance of radiation under the condition using a wind velocity of 5 m/s, the results were as shown in FIG. 5.

Figure 6:
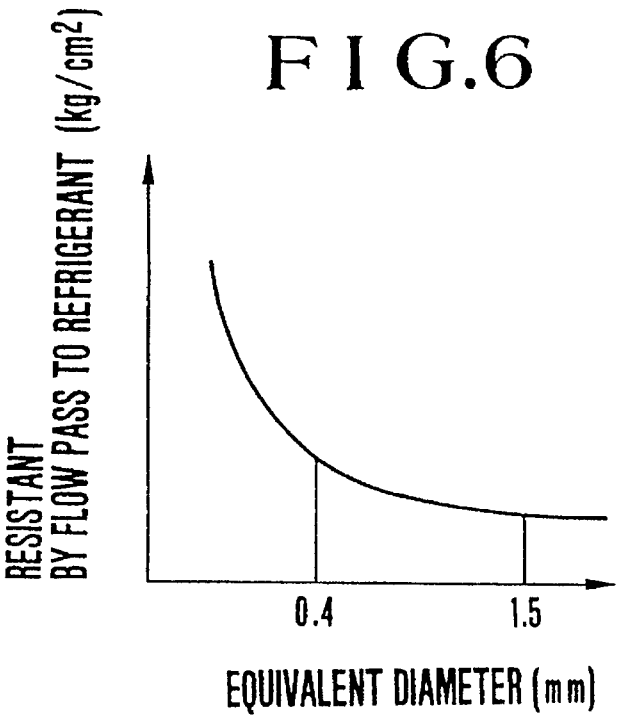

Comparison of the test results obtained of the conventional heat exchanger using a corrugated inner fin (indicated by the dotted line in the diagram) and those obtained of the heat exchanger of the present invention (indicated by the full line in the diagram) reveals that the difference in capacity for radiation was about 1500 Kcal/h where the equivalent diameter was 0.75 mm and about 1,200 Kcal/h where the equivalent diameter was 1.2 mm, clearly implying that in either of the cases, the performance of the zigzagged inner fin 20 of the present invention was about 15% higher than the corrugated inner fin of the conventional heat exchanger. When the heat exchanger of this invention was tested for the resistance offered by the flow paths to the heat-exchanger fluid used as the refrigerant, the results which were as shown in FIG. 6 indicate that the most desirable equivalent diameter was approximately in the range of 0.4 to 1.5 mm.

The embodiment described above is so configured that the edge surfaces E of the corrugated parts $h_2$ of the second stage are positioned at the centers of the corrugated parts $h_1$ of the first stage. It is not an indispensable requisite, however, that the edge surfaces E of the corrugated parts $h_2$ of the second stage should be positioned at the centers of the corrugated parts $h_1$ of the first stage. Optionally, the edge surfaces E of the corrugated parts $h_2$ of the second stage may be positioned between the adjacent corrugated part $h_1$ of the first stage.

The corrugated parts mentioned above are staggered in the direction perpendicular to the direction of the flow of the heat-exchanger fluid. The perpendicular direction is not critical for the staggering. Optionally, the staggering may be made in an oblique direction.

Figure 7:
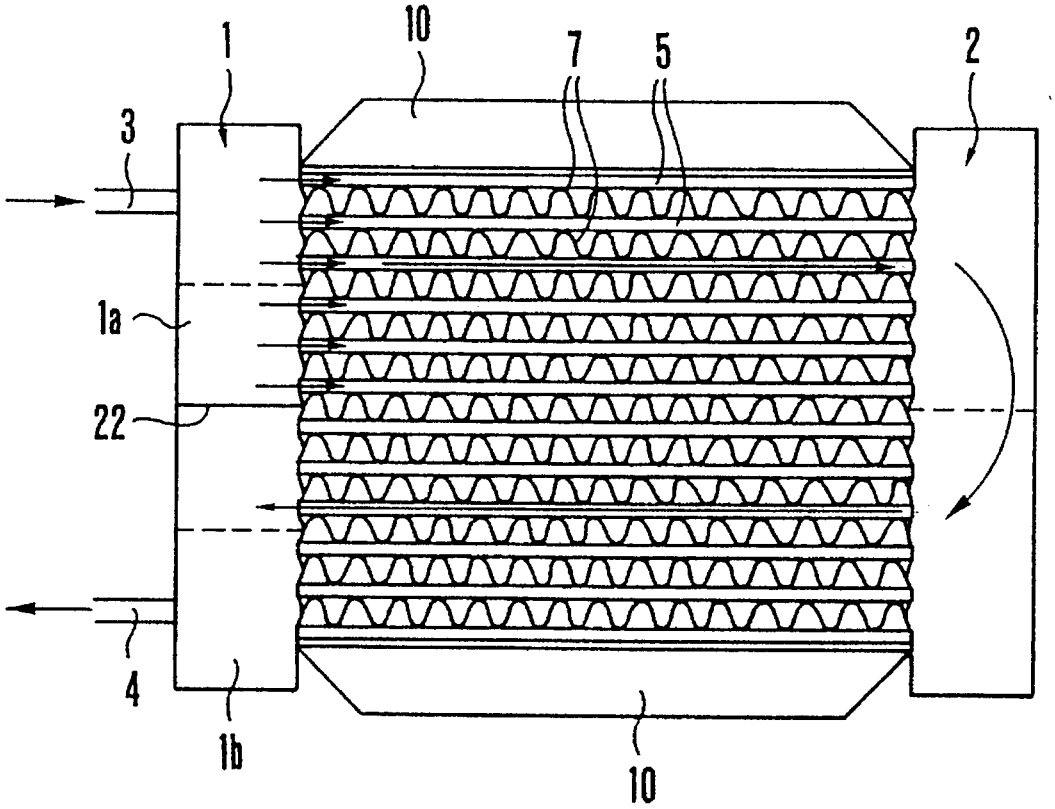
FIG. 7 is a front view illustrating a modification of the heat exchanger mentioned above.

This invention may be embodied in a heat exchanger which is configured as illustrated in FIG. 7. In this heat exchanger, a header pipe 1 is divided into an upper header pipe 1*a* and a lower header pipe 1*b* by a partition plate 22 disposed at the center of the header pipe 1 in the vertical direction thereof, so that the heat-exchanger fluid flowing in through an inlet tube 3 advances through the upper header pipe 1*a*, a flat tube 5, a header pipe 2, a flat tube 5, and the lower header pipe 1*b* and flows out of an outlet tube 4. This heat exchanger has one partition plate 22 disposed inside the header pipe 1 to effect one U-turn flow. Of course, it may have a plurality of partition plates 22 disposed inside the two header pipes 1, 2 (indicated by a broken line in FIG. 7) so as to effect a plurality of U-turn flows.

In the manufacture of the heat exchanger of this multi-flow type, a multiplicity of flat tubes 5 are parallelly disposed between the header pipes 1, 2, corrugated fins 7 are interposed between adjacent flat tubes 5, inner fins 20 are disposed inside the flat tubes 5, and the resultant assembly is placed in a furnace and the component parts thereof are soldered collectively. In the manufacture, even when the liquid flux applied to the projected parts 11*a* of the inner fin 20 inserted in the flat tube 5 flows down the sloped surfaces of the projected parts 11*a*, it is allowed to flow through the holes o (FIG. 4) formed where the corrugated parts h are raised along slits in the inner fin 20 and eventually reach and adhere to the outer periphery of the inner fin 20 on the opposite side, with the result that the flux remaining on the projected parts' side and the flux reaching the opposite side will be distributed so as to coat the whole inner fin almost uniformly. Thus, the union between the inner fin 20 and the flat tube 5 is effected throughout their entire volumes with notably increased strength.

In the attachment of the heat exchanger configured as described above to the car body or some other similar object, the use of the rigidity of the header pipes 1, 2 enables this attachment to be effected with high accuracy with great ease.

Figure 8:
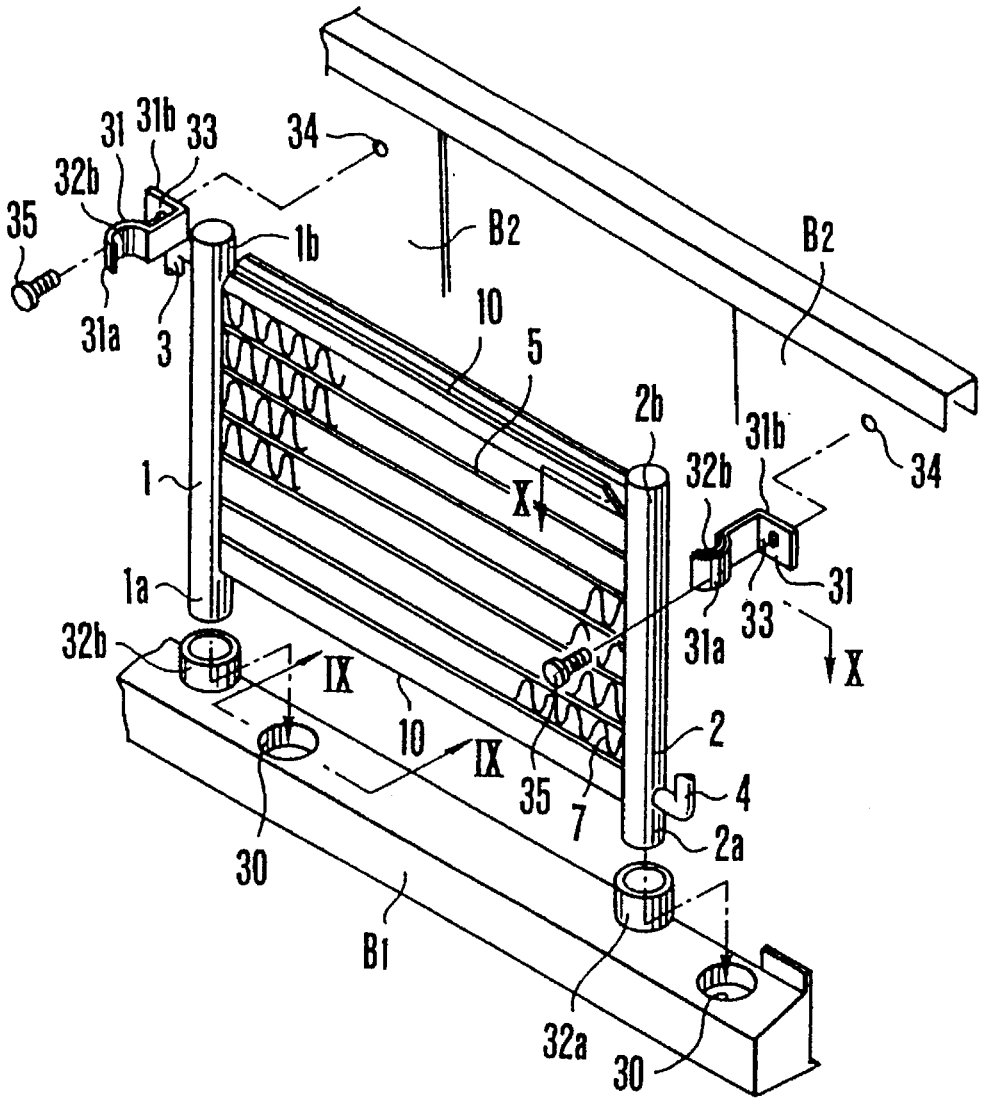
FIG. 8 is an exploded perspective view illustrating the essential part of a mounting structure for the heat exchanger.
Figure 9:
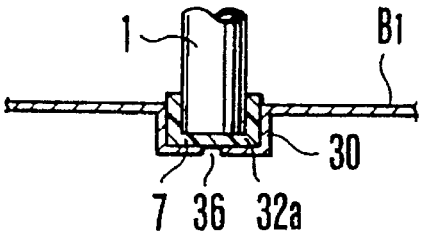
FIG. 9 is a cross section taken through FIG. 8 along the line IX—IX.
Figure 10:
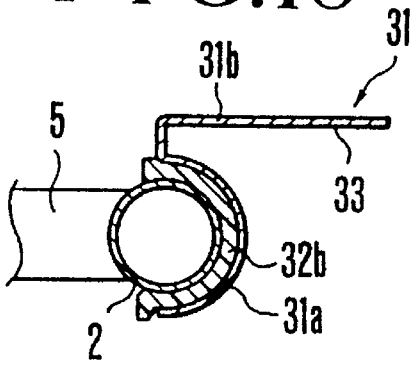
FIG. 10 is a cross section taken through FIG. 8 along the line X—X.

When the lower end of the heat exchanger is attached to the front cross member B1 of the car body and the upper end thereof to the radiator core panel B2 of the car body as illustrated in FIG. 8, cylindrical blind elastic members 32*a* of rubber material formed to conform to the outer contours of the lower ends (one-side ends) 1*a*, 2*a* of the header pipes 1, 2 are slipped over the lower ends 1*a*, 2*a* of the header pipes 1, 2 and the elastic members 32*a* now capping the lower ends 1*a*, 2*a* of the header pipes 1, 2 are inserted into engagement with engaging parts 30 formed to conform to the outer contours of the elastic members 32*a*. The upper ends (the other-side ends) 1*b*, 2*b* of the header pipes 1, 2 are fixed in place by allowing the retaining brackets 31 each provided with a retaining part 31*a* possessing an inner peripheral shape roughly conforming to the outer contours of the header pipes 1, 2 and bent in a semicircular cross section and a mounting part 31*b* having perforated therein an oblong hole 33 for insertion of a bolt 35 to nip elastic members 32*b* possessing an inner peripheral shape conforming to the outer contours of the header pipes 1, 2, and inserting the bolts 35 through the oblong holes 33 into helical engagement with thread holes 54 formed in the radiator core panel B2.

The ealstic members 32*a*, 32*b* mentioned above are not always required to be made of a rubber material but may be made of a foamed material of polyurethane resin, for example. The engaging parts 30 of the front cross member B1 are desired to be perforated with a drain hole 36. Optionally, the elastic members 32*a*, 32*b* may be omitted and the header pipes 1*a*, 2*a* may be directly joined to the front cross member B1 and the header pipes 1*b*, 2*b* may be directly connected to the retaining brackets 31. In consideration of possible errors involved in the manufacture of header pipes 1, 2 of the heat exchanger, the engaging parts of the front cross member B1, and the threaded holes 34 in the radiator core panel B2, however, the interposition of the elastic members 32*a*, 32*b* capable of suitably absorbing such errors proves to be highly desirable.

In the attachment of the heat exchanger to a given object by the use of the mounting structure of the present embodiment configured, as illustrated in FIG. 8, the cylindrical blind elastic members 32*a* of rubber material possessing an inner shape conforming to the outer contours of the header pipes 1, 2 are inserted into the one ends 1*a*, 2*a* of the header pipes. The ends 1*a*, 2*a* capped with the elastic members 32*a* are inserted into engagement with the engaging parts 30 formed in the front cross member B1 and possessing an inner shape conforming to the outer contours of the elastic members 32*a*. Then, the retaining brackets 31 each provided with the retaining part 31*a* possessing an inner peripheral shape substantially conforming to the outer contours of the header pipes 1, 2 and bent in the shape of a semicircular cross section and the mounting part 31*b* having perforated therein the oblong hole 33 for insertion of the bolt 35 are pressed against the other-side ends 1*b*, 2*b* of the header pipes in such a manner as to nip the elastic members 32*b* possessing an inner peripheral shape conforming to the outer contours of the header pipes 1, 2. Thereafter, the bolts 35 are inserted through the oblong holes 33 of the mounting parts 31*b* of the retaining brackets 31 and into the threaded holes 34, to complete the attachment.

As described above, the one-side ends 1*a*, 2*a* of the header pipes of the heat exchanger are inserted into engagement with a given object through the medium of the elastic members 32*a* and, at the same time, the other-side ends 1*b*, 2*b* of the header pipes are attached to a given object with the retaining brackets 31 (accessorial parts) through the medium of the elastic members 31*b*. Owing to this arrangement, the work of attachment to the object can be carried out very easily. Moreover, this arrangement is capable of absorbing possible errors of manufacture.

Figure 11:
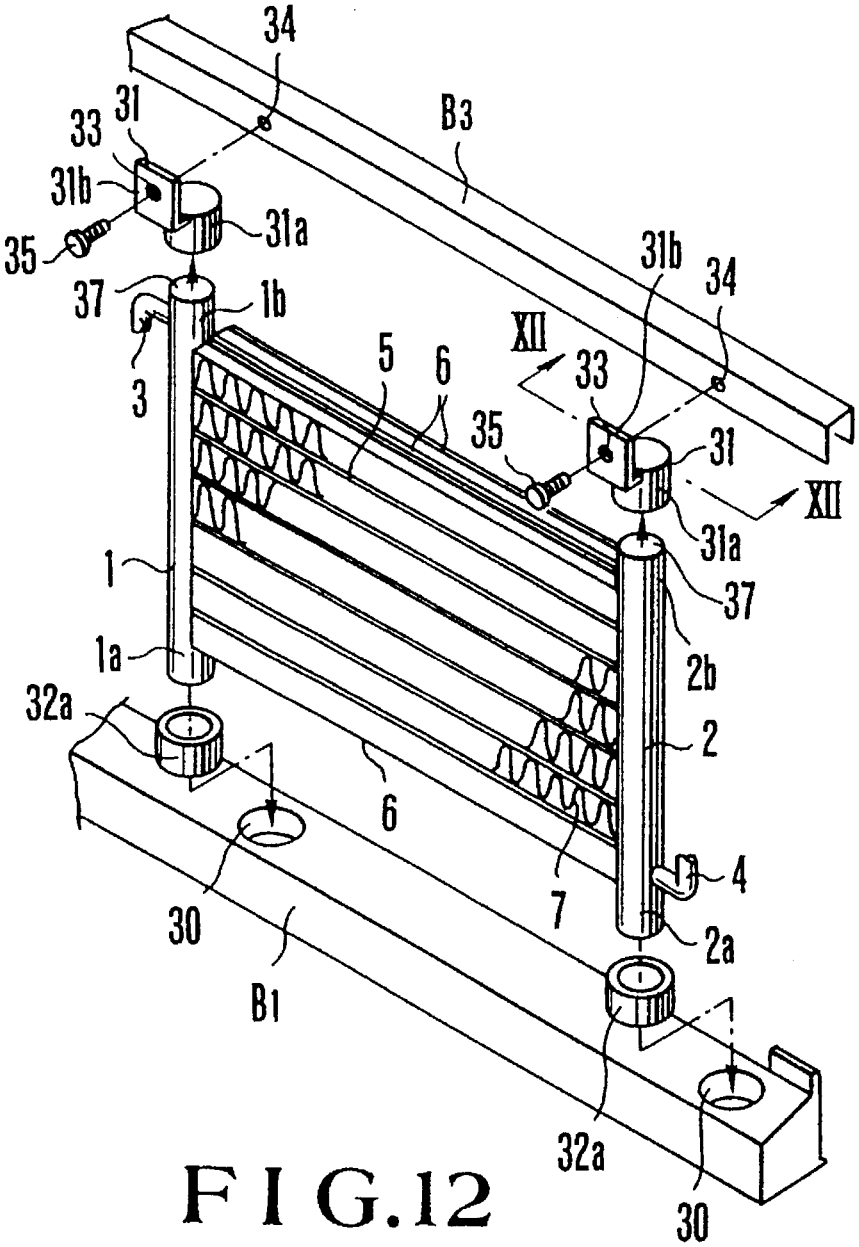
FIG. 11 is an exploded perspective view illustrating the essential part of another mounting structure for the heat exchanger mentioned above.
Figure 12:
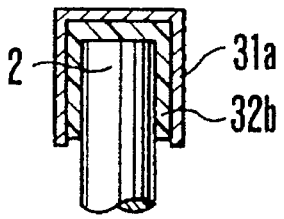
FIG. 12 is a cross section taken through FIG. 11 along the line XII—XII.

FIG. 11 is an exploded perspective view illustrating the essential part of a modified mounting structure for the heat exchanger and FIG. 12 is a cross section taken through FIG. 11 along the line XII—XII.

This mounting structure for the heat exchanger typifies a case in which the object for attachment of the heat exchanger is a car body and the lower ends 1*a*, 2*a* of the header pipes 1, 2 are fastened to the front cross member B1 and the upper ends 1*b*, 2*b* of the header pipes 1, 2 to an upper rail B3. Into the upper ends 1*b*, 2*b* of the header pipes 1, 2 of the heat exchanger, roughly cylindrical elastic members 32*b* possessing inner shapes conforming to the outer contours of the header pipes 1, 2 are inserted. Further, these elastic members 32*b* are inserted into the retaining brackets 31 each comprising a roughly cylindrical retaining part 31*a* possessing an inner shape conforming to the outer contours of the elastic members 31*b* and a mounting part 31 having an oblong hole 33 perforated therein. When the heat exchanger provided with this mounting structure is attached to the car body, for example, the lower ends 1*a*, 2*a* of the header pipes are inserted into the elastic members 32*a* and simultaneously inserted into engagement with the engaging parts 30 of the front cross member B1. Then, the elastic members 32*b* are inserted into the upper ends 1*b*, 2*b* of the header pipes and further the retaining brackets 31 are inserted therein and the bolts 35 are inserted into the oblong holes 33 perforated in the retaining brackets 31. Subsequently, the bolts 35 are screwed to the tapped holes 34 formed in the upper rail B3, to complete the attachment of the heat exchanger to the car body.

Figure 13:
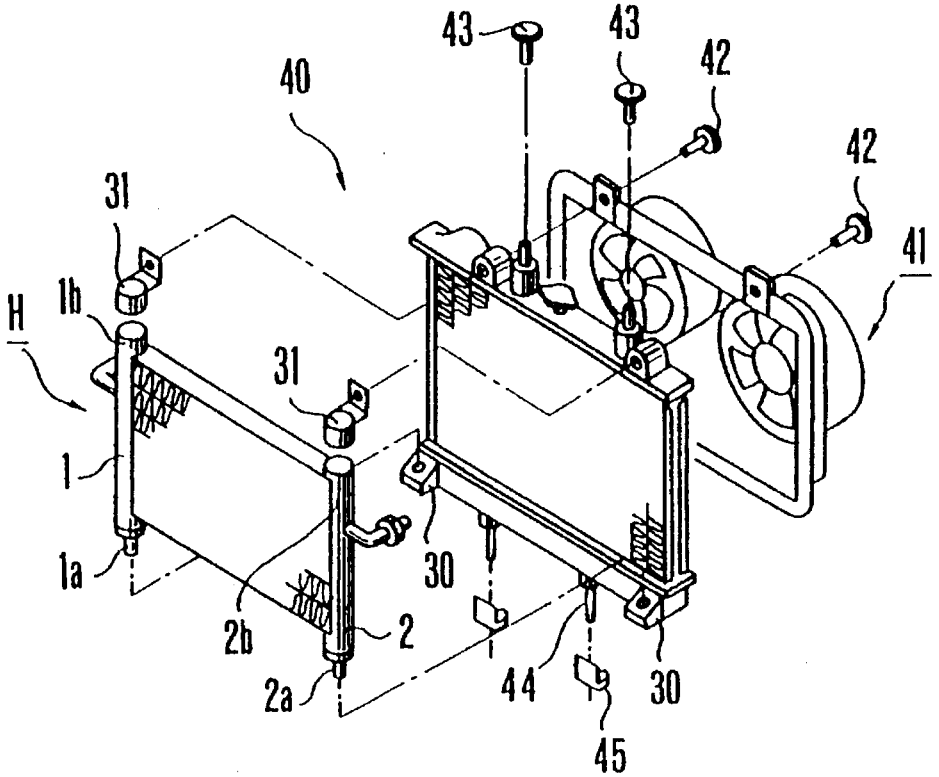
FIG. 13 is an exploded perspective view illustrating yet another mounting structure for the heat exchanger mentioned above.

FIG. 13 is an exploded perspective view illustrating yet another modification of the mounting structure for the heat exchanger. In this case, the mounting structure is adapted so that the heat exchanger (condenser for an automobile air conditioner) H is attached to a radiator 40 and the radiator 40 is attached to the car body. The engaging parts 30 for insertion of the lower ends 1*a*, 2*a* of the header pipes 1, 2 of the heat exchanger H are formed beneath a radiator 40, an object meant as a base for mounting, and the retaining brackets 31 are inserted into the upper ends 1*b*, 2*b* of the header pipes 1, 2 so as to permit penetration of the bolts 42 for connecting the radiator 40 to fan shrouds 41. The attachment of the heat exchanger H, the radiator 40, and the fan shroud 41 to the car body is attained by first inserting the lower ends of the header pipes 1, 2 of the heat exchanger H into the engaging parts 30 of the radiator 40, then inserting the brackets 31 into the upper ends 1*b*, 2*b* of the header pipes 1, 2, tying the retaining brackets 31, the radiator 40, and the fan shroud 41 together with bolts thereby fastening the heat exchanger H to the raditor 40, and subsequently attaching the assembled components H, 40, and 41 to the car body as with bolts 43. In the diagram, the reference numeral 44 denotes a projection formed beneath the radiator and the reference numeral 45 devotes a bracket attached to the car body and adapted to receive the aforementioned projection.

In the arrangement described above, since the heat exchanger H, the radiator 40, and the fan shroud 41 are integrally joined to the car body, the work of assembling the car body can be carried out with improved efficiency.

Figure 14:
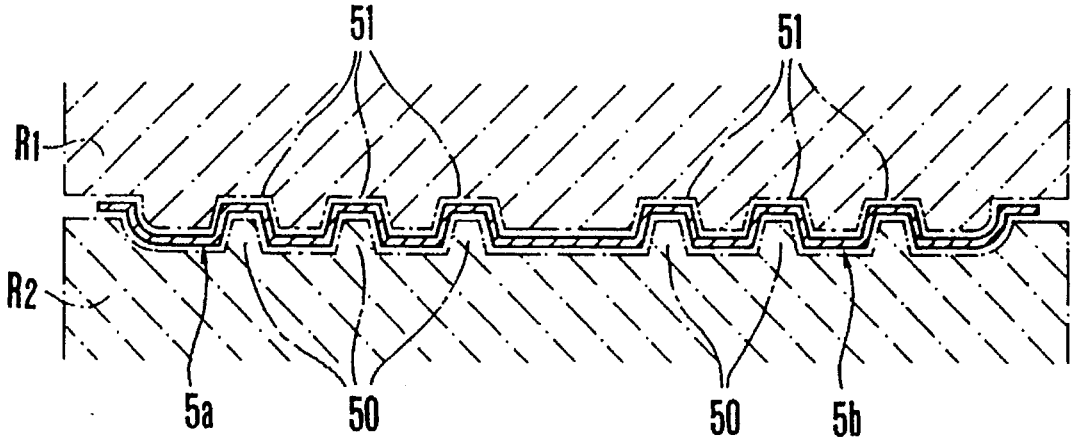
FIG. 14 is a cross section illustrating a flat tube for use in another embodiment of this invention in the process of shaping.

FIG. 14 illustrated yet another embodiment of this invention, in which the baffle member G mentioned above is not formed separately of the flat tube like the inner fin 20 but is formed of the flat tube itself.

Figure 15:
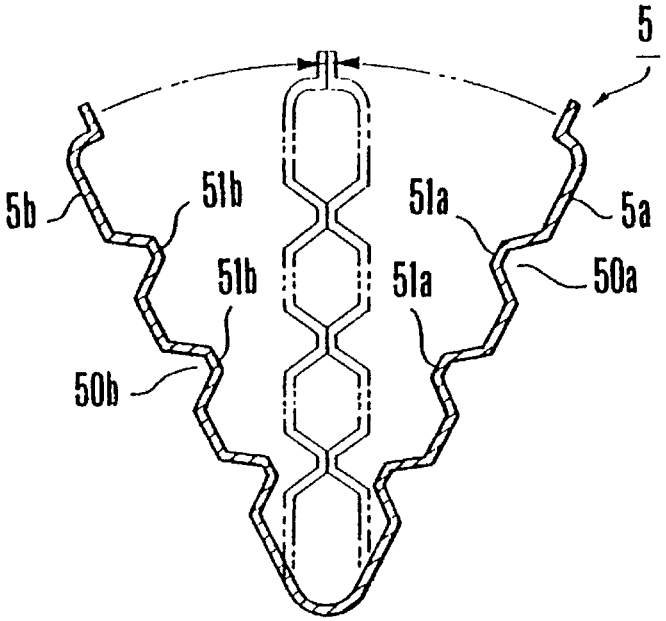
FIG. 15 is a cross section illustrating the same flat tube in the process of bending.

This flat tube 5 is obtained by forming a plurality of dimples 50*a*, 50*b* in a flat plate with roll $R_1$ and $R_2$ as illustrated in FIG. 14, then folding the halved flat tubes 5*a*, 5*b* roward each other as illustrated in FIG. 15 into a state indicated by the broken line, and joining the outer edges and the opposed dimples as by soldering.

Figure 16A:
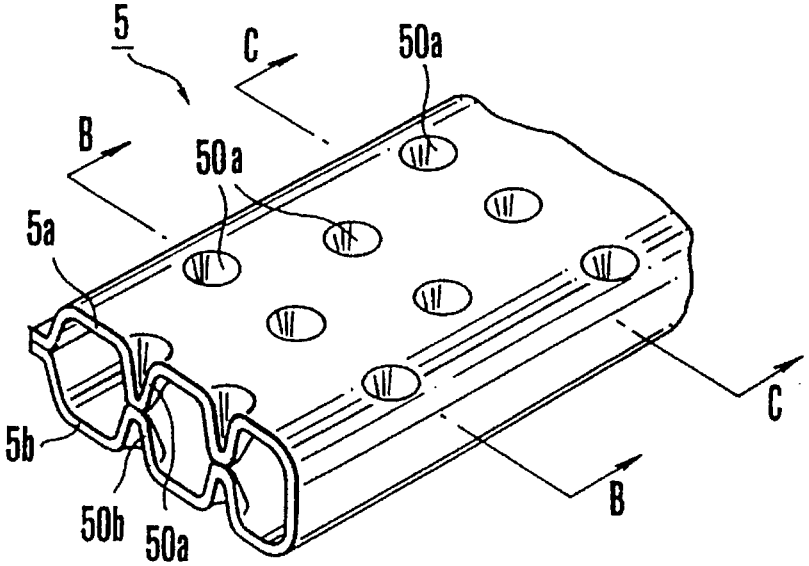
FIG. 16 (A) is a perspective view of the flat tube and FIGS. 16 (B) and (C) are cross section taken through FIG. 16 (A) respectively along the line B—B and the line C—C.

The halved flat tubes 5*a*, 5*b* are formed by the rolling operation using the two rolls $R_1$, $R_2$ possessing cross sections indicated by a dashed line in FIG. 14. These two forming rolls $R_1$, $R_2$ are formed in shapes corresponding to the shapes of the halved flat tubes 5*a*, 5*b* and they have formed therein protuberances 50 and recesses 51 corresponding to the dimples 50*a*, 50*b*. When a flat aluminum plate is passed between the two forming rolls $R_1$, $R_2$, therefore, the halved flat tubes 5*a*, 5*b* can be easily produced. Since the two halved flat tubes 5*a*, 5*b* are symmetrically identical with each other, it suffices to prepare one set of forming rolls $R_1$, $R_2$ for the production of halved flat tubes. This fact contributes to economizing the equipment cost. When the formed flat plate is folded along the central portion over itself as illustrated in FIG. 15, the dimples 50*a*, 50*b* thrust out as opposed to each other at the positions corresponding to those of the to halved flat tubes 5*a*, 5*b* as indicated by the broken line in FIG. 15, with the apexes 51*a*, 51*b* thereof coming into tight contact with each other. Then, by soldering the contiguous apexes 51*a*, 51*b* at the time that the outer edges are soldered, the flat tube illustrated in FIG. 16 (A) is completed. This flat tube 5 has, in the two halved flat tubes 5*a*, 5*b*, formed dimples 50*a*, 50*b* spaced with a fixed pitch Pd as illustrated in FIG. 16 (B).

Figure 16B:
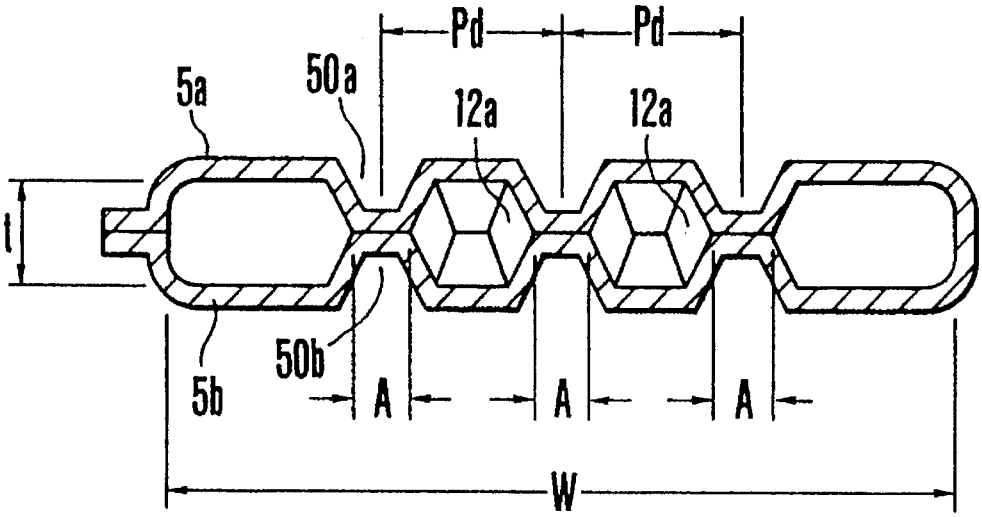
Figure 16C:
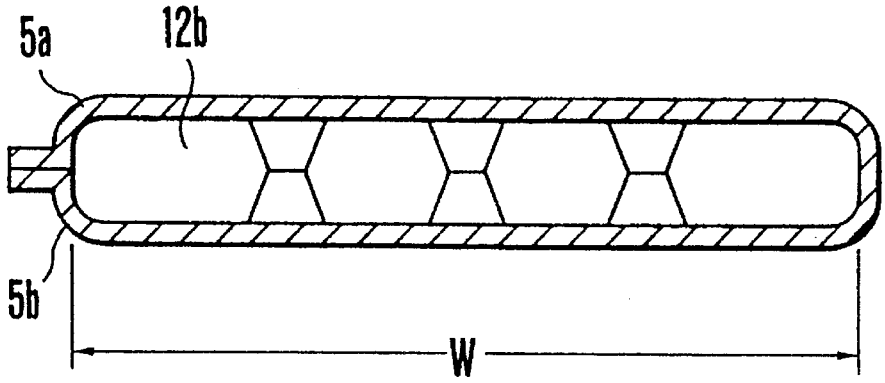
Figure 17:
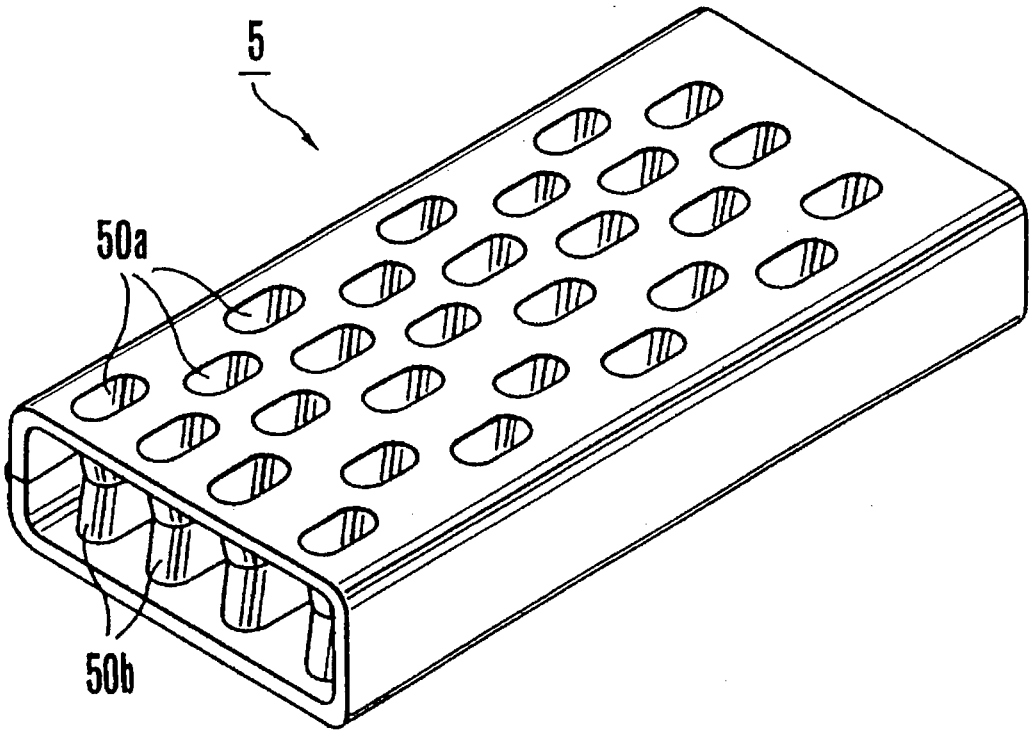
FIG. 17 is a perspective view illustrating another embodiment of the flat tube.

In this flat tube 5, a plurality of small flow paths 12*a* (FIG. 16B refers) are defined by the dimples 50*a*, 50*b* and flow paths 12*b* (FIG. 16C refers) are formed in the portions containing none of the dimples 50*a*, 50*b*, describing a cross section perpendicular to the axis, and having a thickness equal to the inner thickness t of the tube and a width denoted by W. The dimples 50*a*, 50*b* may have a circular shape as illustrated in FIG. 16 (A) or an elliptical shape as illustrated in FIG. 17. The small flow paths defined by these dimples 50*a*, 50 *b* are desired to be formed with due consideration to the prescribed equivalent diameter mentioned above. Of course, the flat tube 5 may be produced by the use of an electric welded tube of the kind illustrated in FIG. 17.

Figure 18:
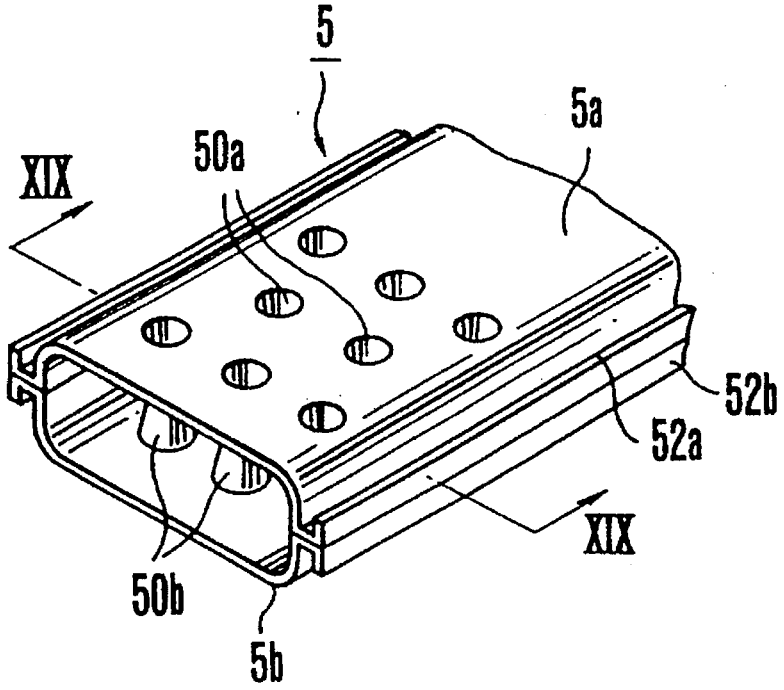
FIG. 18 and FIG. 19 are a perspective view and a cross section illustrating yet another typical flat tube.
Figure 19:
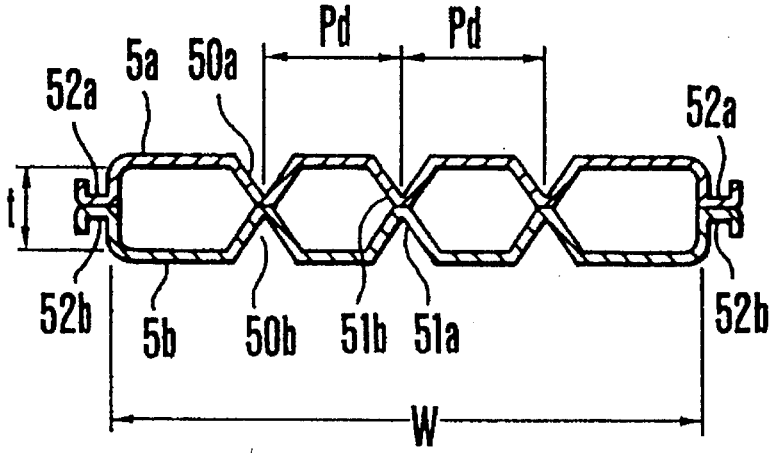

The two halved flat tubes 5*a*, 5*b* mentioned above may be formed separately of each other as illustrated in FIG. 18 and FIG. 19. Those illustrated in FIG. 18 and FIG. 19 have folded flanges 52*a*, 52*b* formed along the edges of the two halved flat tubes 5*a*, 5*b* in such a manner that the flanges 52*a*, 52*b* abut each other when the two halved flat tubes 5*a*, 5*b* are joined to each other. In this arrangement, the area available for the application of solder is increased and the strength of union by the soldering is enhanced and the work of soldering is improved.

The inside thickness t of the flat tube 5 and the pitch Pd between the adjacent dimples 50*a*, 50*b* are desired to be determined at suitable values in accordance with various conditions of the heat exchanger of this invention such as capacity for exchange of heat and resistance to pressure. It has been established by experiments that the thickness, t, the pitch, Pd, and the width, A, of joint at the apex of dimple are desirably in the following ranges.

t=0.5 to 1.7 mm

Pd=2 to 4 mm

A=1 to 2 mm.

The preferred ranges of these magnitudes will be described in detail below with reference to the graphs of FIGS. 20 to 25 showing pertinent test results.

Figure 20:
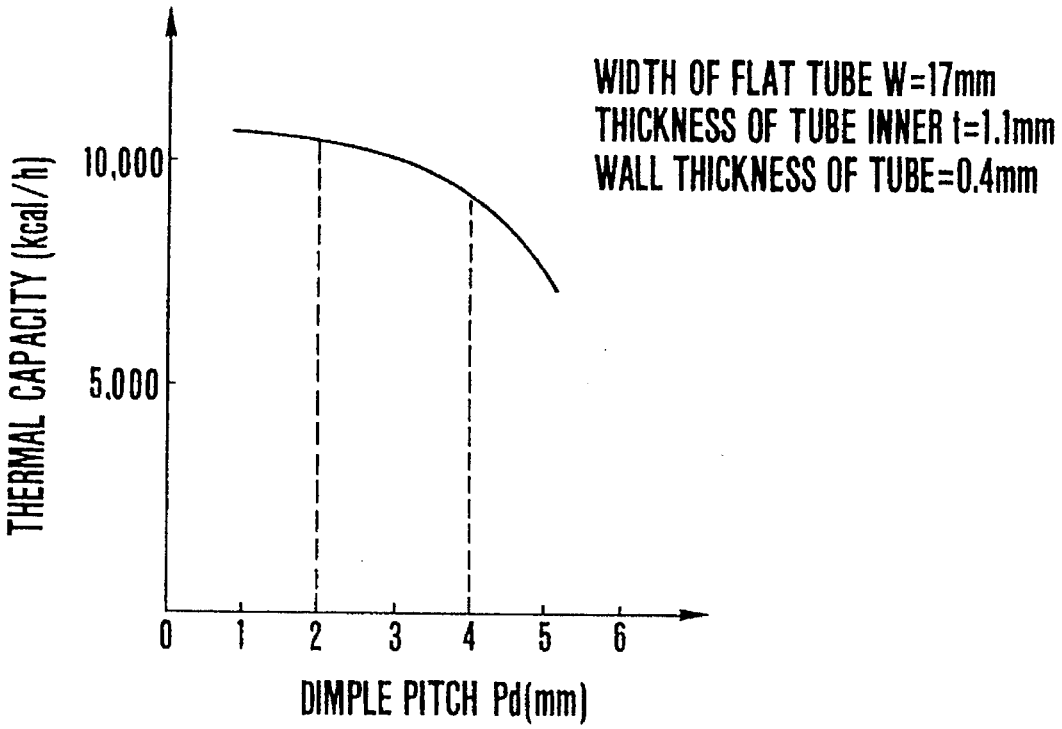
FIGS. 20 to 25 are graphs showing the results of tests performed on the heat exchanger of this invention.

FIG. 20 is a graph showing the heat exchange capacity of a heat exchanger formed of a flat tube 5 having a width, W, of 17 mm, an inner tube thickness, t, of 1.1 mm, and a tube wall thickness of 0.4 mm as the function of the dimple pitch, Pd, of the heat exchanger.

Figure 21:
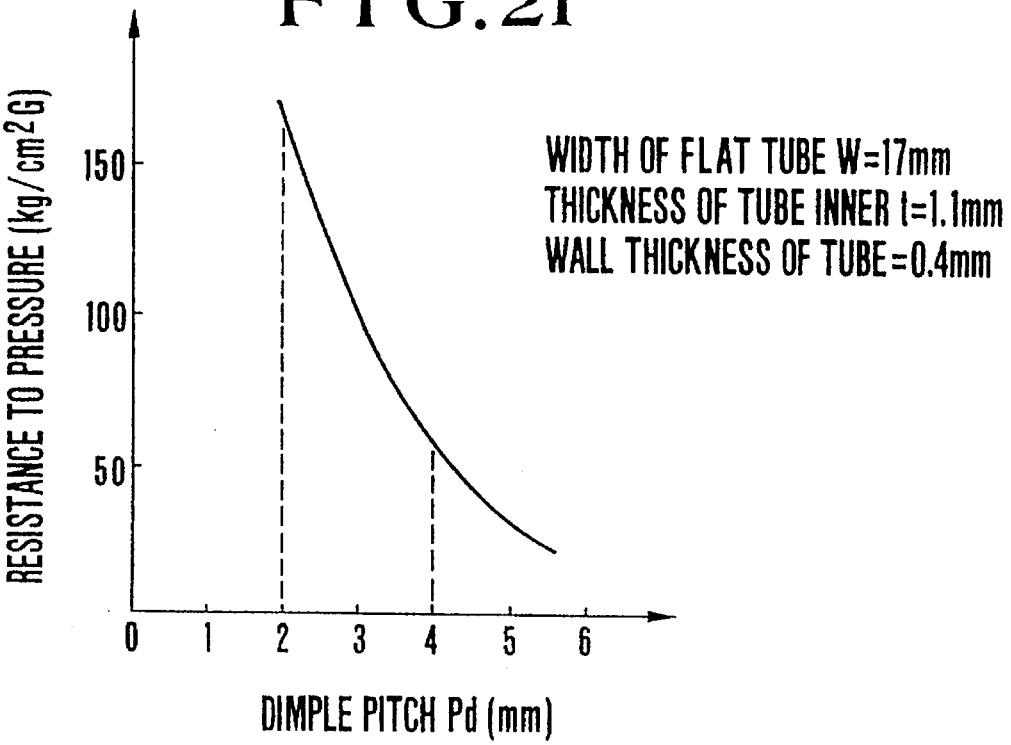

FIG. 21 is a graph showing the change of pressure resistance of the flat tube 5 as the function of the dimple pitch Pd as determined of the same flat tube as described above.

Figure 22:
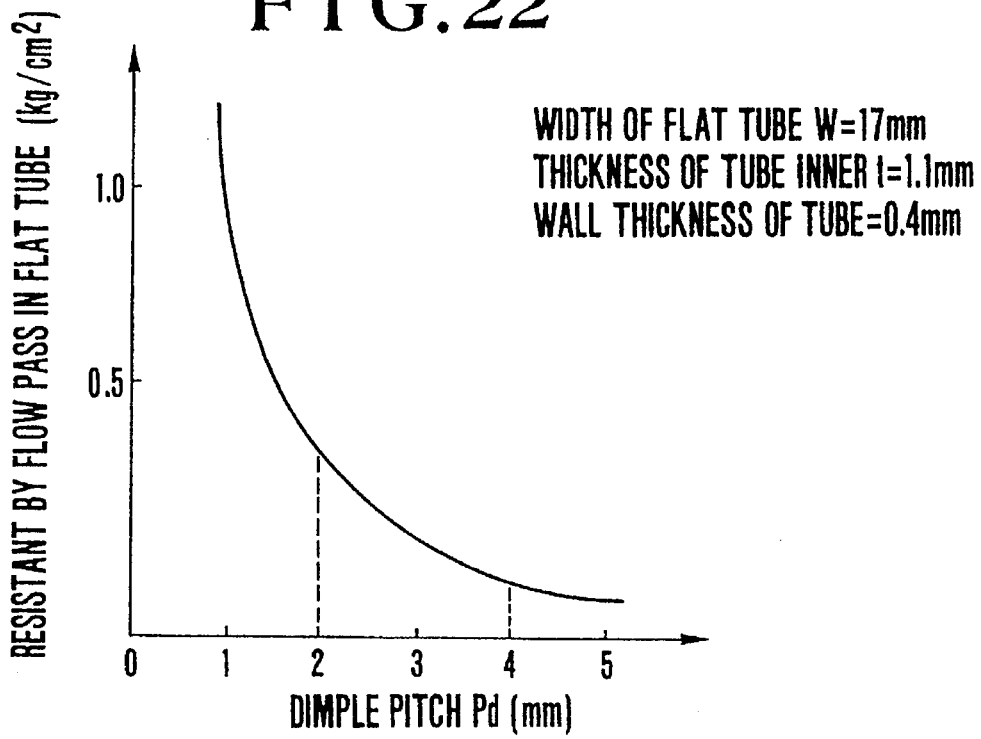

FIG. 22 is a graph showing the change of the resistance of the flow paths inside the flat tube 5 having a width, W, of 17 mm, an inner tube thickness, t, of 1.1 mm, and a tube wall thickness of 0.4 mm as the function of the dimple pitch Pd in the heat exchanger using the flat tube 5.

Figure 23:
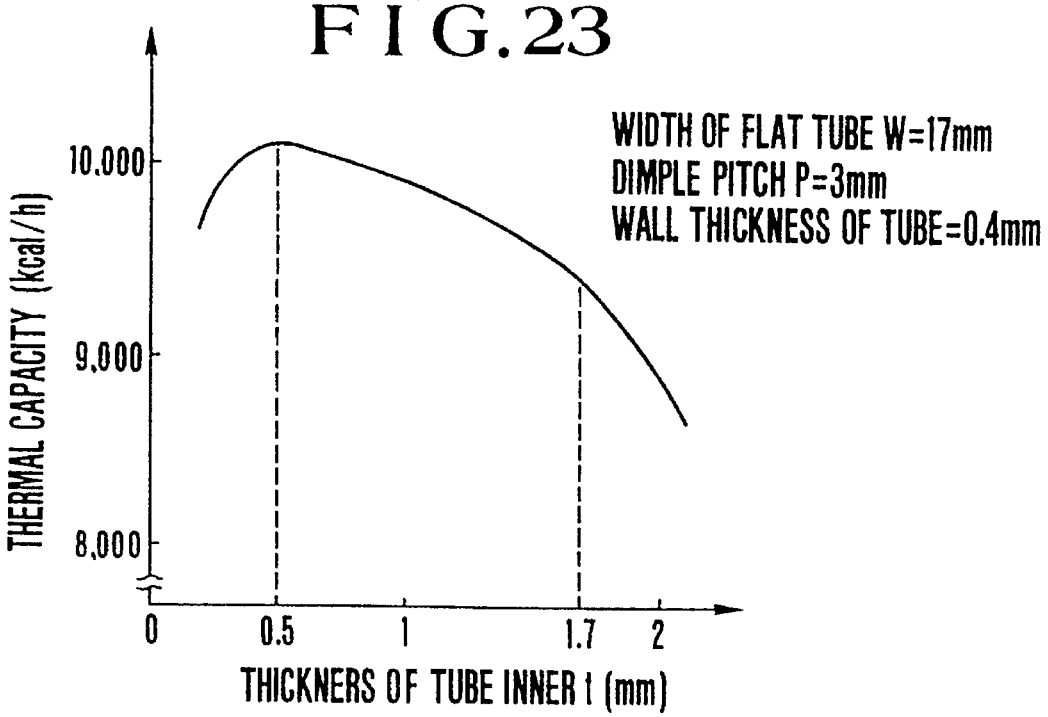

FIG. 23 is a graph showing the change of the heat exchange capacity of the heat exchanger using the flat tube 5 having a width, W, of 17 mm, a tube wall thickness of 0.4 mm, and a dimple pitch, Pd, of 3 mm as the function of the tube wall thickness, t.

It is noted from FIGS. 20 to 22 that the ability and pressure resistance of the heat exchanger were improved by setting the dimple pitch, Pd, at a small value. When the dimple pitch, Pd, was set at an unduly small value, however, there arose the possibility that the size of the plurality of flow paths defined by the dimples 50*a*, 50*b* would decrease excessively and the resistance to the flow of the fluid subjected to heat exchange would conversely increase as shown in FIG. 21. These results indicate that the dimple pitch, Pd, is preferably in the range of 2 to 4 mm. It is noted from FIG. 23 that the ability of the heat exchanger increased in proportion as the inside thickness, t, of the flat tube 5 decreased. Again in this case similarly to the case of the dimple pitch, Pd, the resistance to the flow of the fluid subjected to heat exchange increased and the load required for supply of the fluid increased when the inside thickness, t, of the flat tube decreased excessively. It may well be concluded from these results that the inside thickness, t, of the flat tube is suitable in the range of 0.5 to 1.7 mm.

Figure 24:
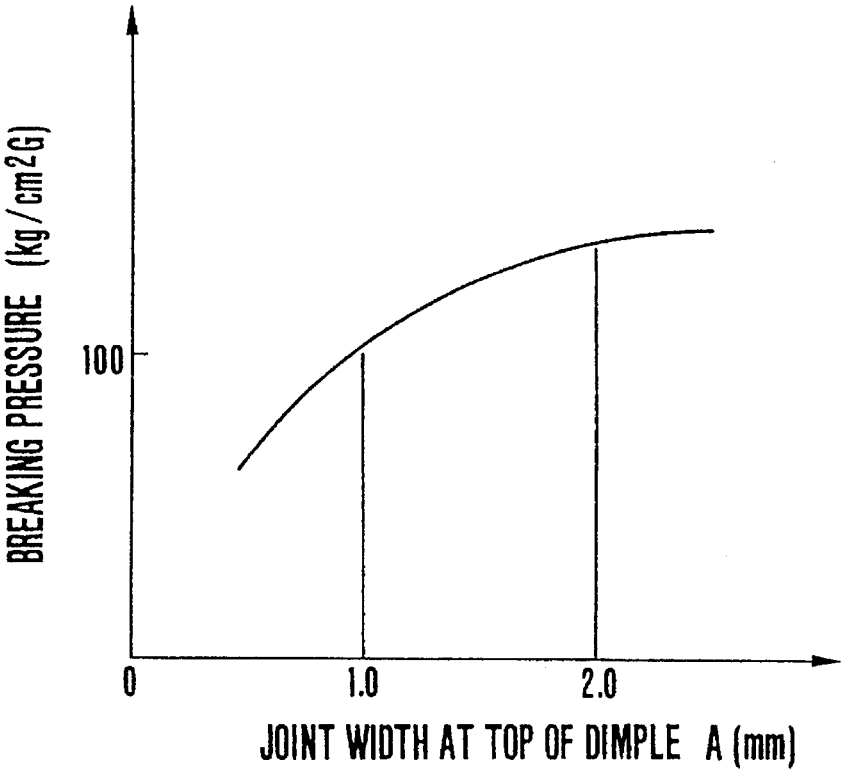
Figure 25:
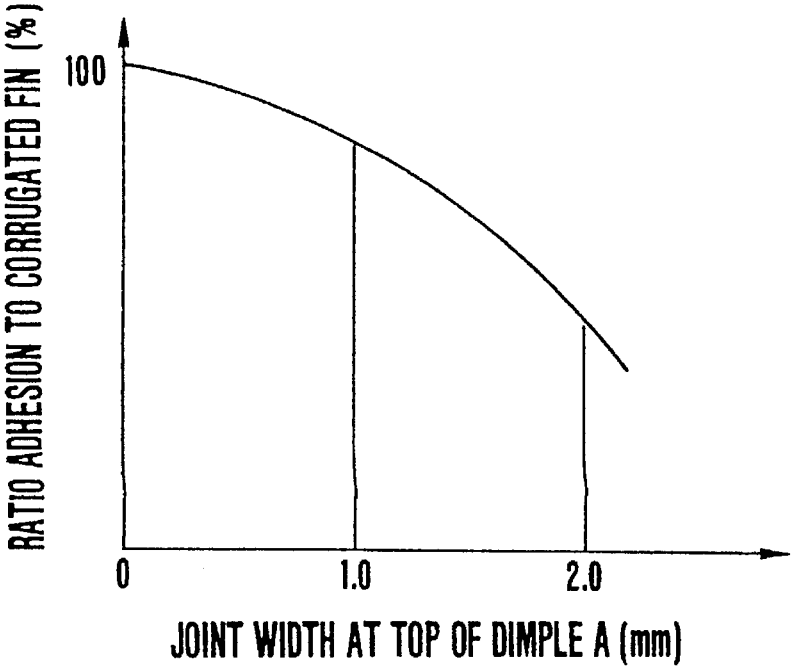
Figure 26:
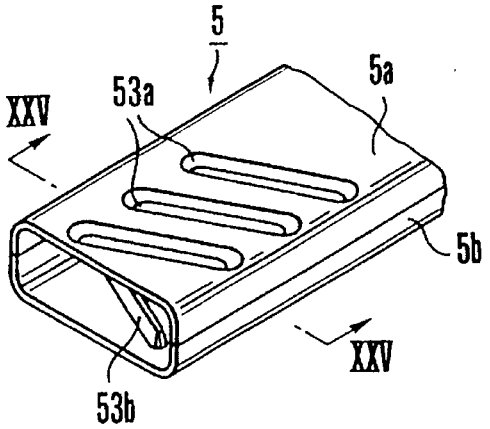
FIGS. 26 and 27 and FIGS. 28 and 29 are pairs each of a perspective view and a cross section illustrating yet other flat tubes.

In order for the heat exchanger to resist the breaking pressure, the width, A, of joint between the leading ends of the dimples 50*a*, 50*b* is desired to be as large as permissible. As concerns the ratio of adhesion of the corrugated fin 7 to the flat tube 5, however, the width, A, is desired to be small. The experiments conducted to determine the effects of the width, A, of joint between the leading ends of the dimples 50*a*, 50*b* demonstrated that the width was optimal in the range of 1 to 2 mm as shown in FIG. 24 and FIG. 25. These data on the width, A, are applicable to the soldered tube shown in FIG. 16A and to the electric welded tube shown in FIG. 17.

The manufacture of the heat exchanger of the multi-flow type of the present embodiment configured as described above is started by shaping the halved flat tubes 5*a*, 5*b* by the rolling technique mentioned previously and, at the same time, forming the plurality of dimples 50*a*, 50*b*. Then, the flux is applied on the inner and outer sides of the halved flat tubes 5*a*, 5*b* before these halved flat tubes are joined.

However the joint by welding can do it after assembling the header pipes 1,2, the corrugated fin 7 and soon. Subsequently, the two halved flat tubes 5*a*, 5*b* are joined to each other, placed in the heating furnace, and silvered therein. In this case, since the application of the flux is carried out before the halved flat tubes 5*a*, 5*b* are joined to each other, the works involved are very easy to perform. Further, since the flux is uniformly applied inside the halved flat tubes 5*a*, 5*b*, the possibility of the flux clogging the small flow paths to be formed between the dimples 50*a*, 50*b* is nil. The opposite ends of a plurality of flat tubes 5 obtained as described above are inserted into the corrugated fin 7 between them, and the ends of said flat tubes 5 are insurted in the engaging holes (not shown) bored in the header pipes 1, 2, and welding lump together as a whole, the corrugated fins 7 are interposed between the flat tubes 5 and the corrugated fins 7 are integrally joined by soldering.

Figure 27:
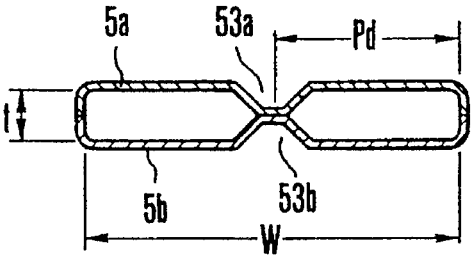
Figure 28:
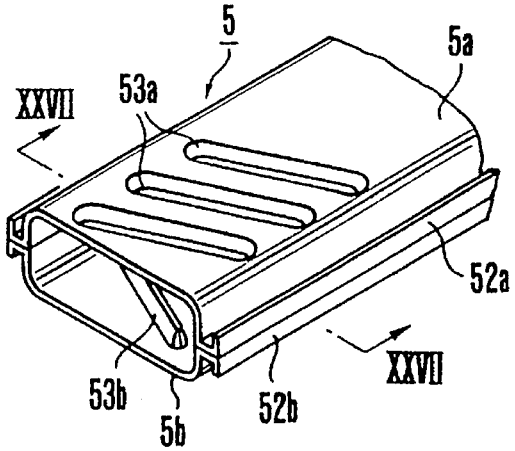
Figure 29:
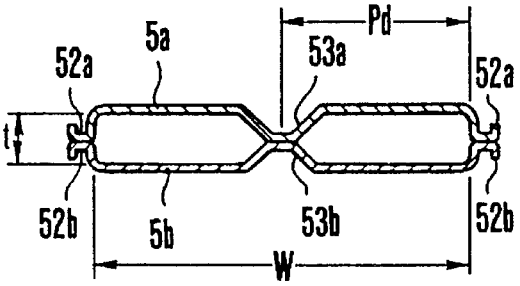

The dimples 50*a*, 50*b* described above may be formed in richly varied shaped. For example, by forming a plurality of substantially parallel beads 53*a* in one halved flat tube 52, forming a plurality of beads 53*b* intersecting the aforementioned beads 53*a* in the other halved flat tube 5*b*, and then joining these two halved flat tubes 5*a*, 5*b* as illustrated in FIGS. 26 to 29 similarly to the embodiment described above, flow paths may be partitioned inside the flat tube 5 by virtue of the intersection of the beads 53*a*, 53*b* as illustrated in FIGS. 27 and 29. The difference between the embodiment illustrated in FIGS. 26 and 27 and the embodiment illustrated in FIGS. 28 and 29 resides in the joining structure for the opposed edges of these two halved flat tubes 5*a*, 5*b*.

Figure 30:
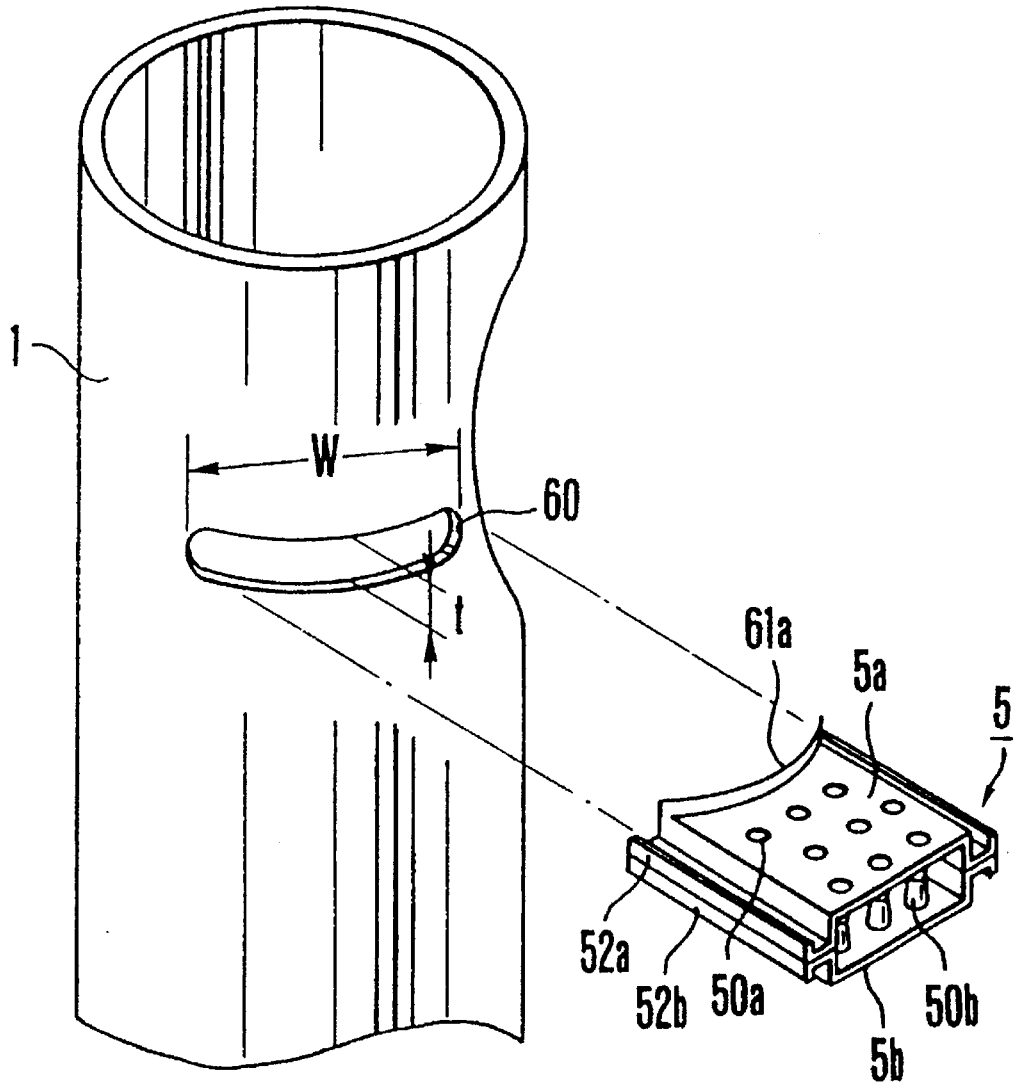
FIG. 30 is an exploded perspective view illustrating the state of connection between the flat tube mentioned above and header pipes.

In order to ensure safe union between the header pipes 1, 2 and the terminal parts of the flat tubes each consisting of halved flat tubes 5*a*, 5*b* separately formed by the rolling technique, the terminal parts are desired to be formed as illustrated in FIG. 30.

The flat tube 5 has, in the terminal parts thereof, formed abutting parts 61*a* adapted to make close contact with the header pipes 1, 2, so that the flat tubes 5 and the header pipes 1, 2 will be held in intimate contact with each other while they are being soldered in the furnace. The abutting parts 61*a* each consist of flanges formed one each in the terminal parts of the halved flat tubes 5*a*, 5*b*. They are formed by the pressing technique after the halved flat tubes 5*a*, 5*b* have been formed by rolling in the shape having a U cross section perpendicular to the axis. They are formed in a shape conforming to the outer peripheral surfaces of the header pipes 1, 2 surrounding the engaging holes 60 bored in the header pipes 1, 2. The flow paths to be formed inside the flat tube 5 when the two halved flat tubes 5*a*, 5*b* are joined substantially conform to the engaging holes 60 mentioned above.

Since this embodiment has no use for the inner fin 20, it obviates the necessity for the step of inserting the inner fin 20 into the flat tube 5 and the step of crushing the flat tube 5 after the insertion of the inner fin 20 therein. It further permits prevention of the flat tube from the clogging ascribable to the improvement in the work of application of the flux. This embodiment also facilitates the work of assembling the heat exchanger and heightens the productivity in the manufacture of heat exchangers.

Figure 31:
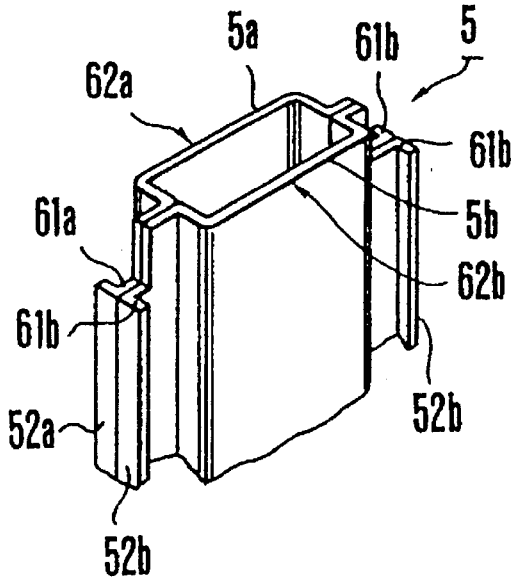
FIG. 31 and FIG. 32 are perspective views illustrating other typical terminal parts of the flat tube mentioned above.

The flat tube 5 may be configured as illustrated in FIG. 31. This flat tube 5 is provided at each of the terminal parts thereof with inserting parts 62*a*, 62*b* conforming in shape to the engaging holes 60 and abutting parts 61*a*, 61*b* conforming to the peripheral edges of the engaging holes. This flat tube 5 is obtained, similarly to that of FIG. 30, folding a flat plate in a shape having a U cross section perpendicular to axis while the flat plate is being rolled to produce two halved flat tubes 5*a*, 5*b*, forming the flange parts 52*a*, 52*b* at the opposite terminals of the folded flat plate, and simultaneously forming a plurality of dimples 50*a*, 50*b* in the flat portions of the halved flat tubes 5*a*, 5*b*. Then, the flange parts 52*a*, 52*b* in the lateral terminal parts of the halved flat tubes 5*a*, 5*b* are partially cut off as illustrated in FIG. 31 and the two halved flat tubes 5*a*, 5*b* are joined. As the result, the terminal surfaces of the flange parts 52*a*, 52*b* come into fast contact with the engaging holes 60 and, at the same time, the inserting parts 62*a*, 62*b* of the flat tubes 5*a*, 5*b* having the flange parts thereof 52*a*, 52*b* partially cut off are inserted into the engaging holes 60.

When the inserting parts 62*a*, 62*b* and the abutting parts 61*a*, 61*b* are formed in the opposite terminal parts of the flat tube 5 as described above, therefore, the sizes of the engaging holes 60 allowed for insertion are fixed owing to the positioning of the abutting parts 61*a*, 61*b* at the time that the flat tube is attached to the engaging holes of the header pipes 1, 2. As the result, the work of assemblage is facilitated to a great extent.

Figure 32:
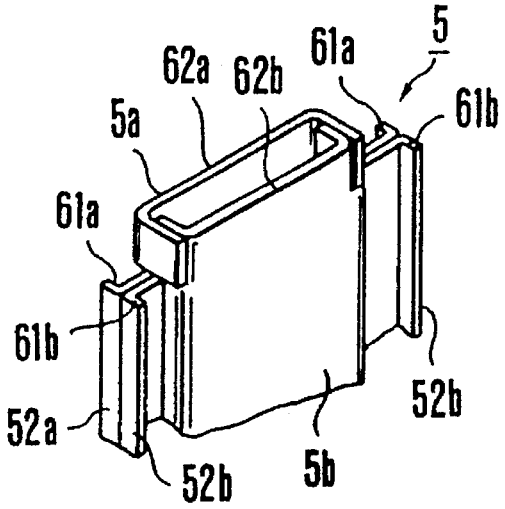
Figure 33:
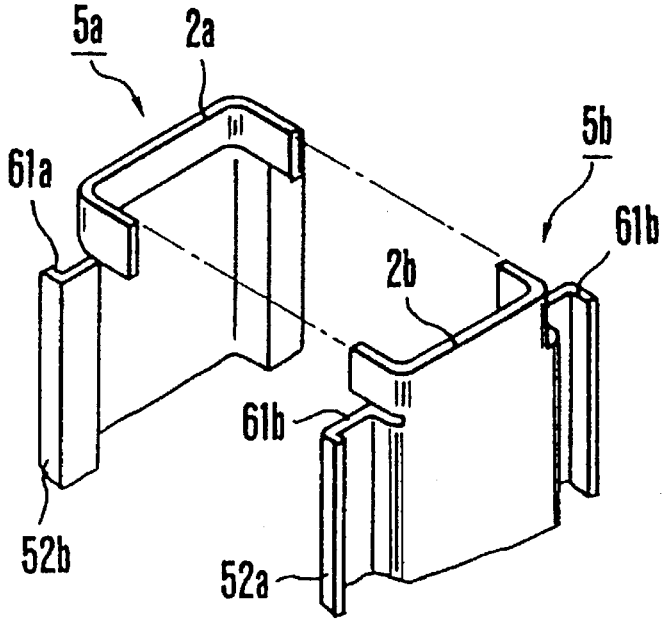
FIG. 33 is an exploded perspective view of the flat tube appearing in FIG. 32.
Figure 34:
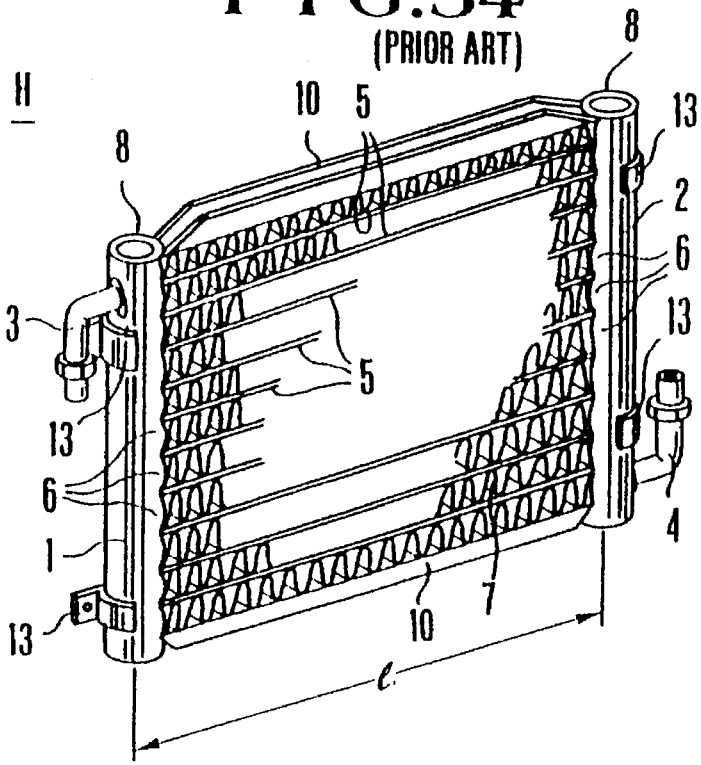
FIG.34 (PRIOR ART)
FIG. 34 is a perspective view of the conventional heat exchanger.
Figure 35:
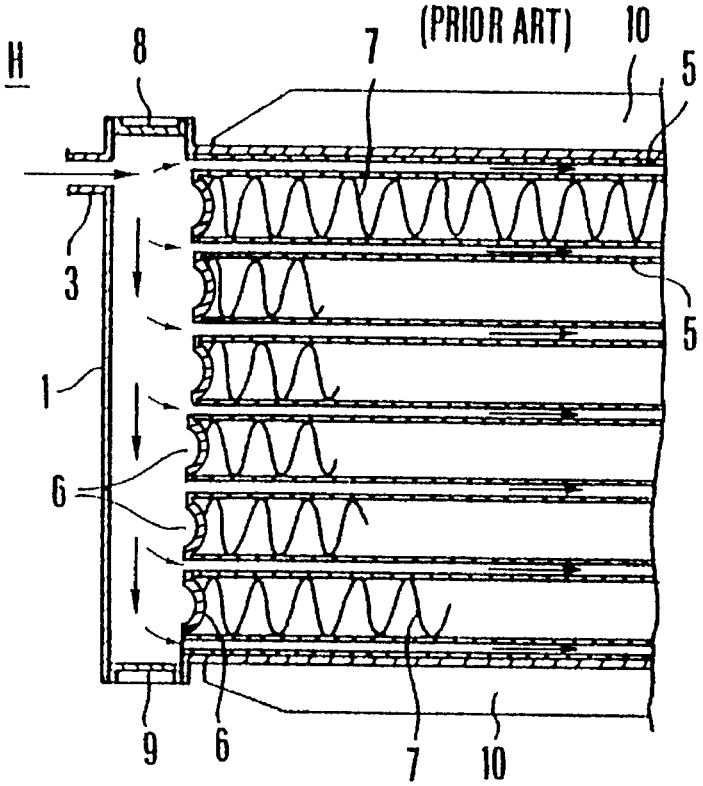
FIG.35 (PRIOR ART)
FIG. 35 is a cross section of FIG. 36 is a cross section of the flat tube of the conventional heat exchanger mentioned above.
Figure 36:
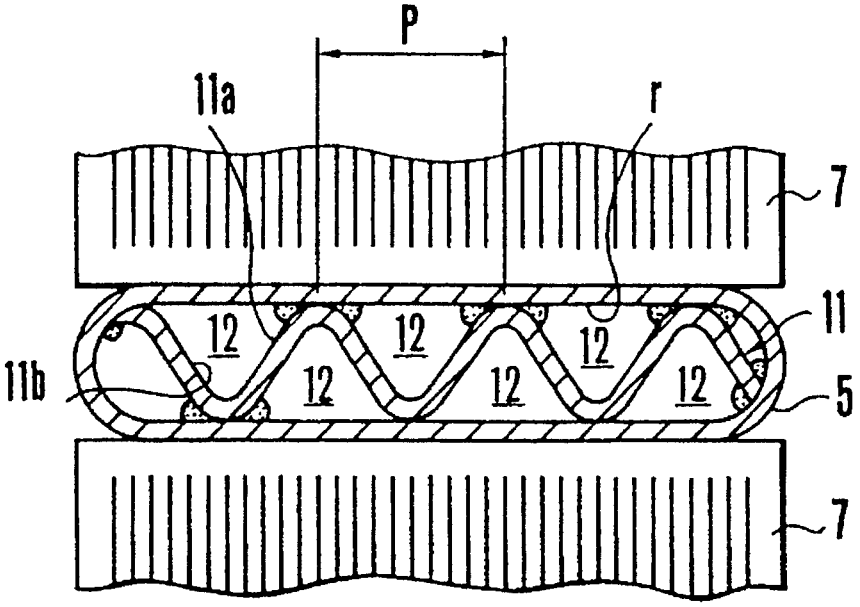
FIG.36 (PRIOR ART)

In the flat tube 5 illustrated in FIGS. 32 and 33, the terminal parts of one, 5*b*, of the halved flat tubes formed by rolling similarly to those of FIG. 31 are folded back in the direction away from the flange parts 52*a*, 52*b* by the pressing technique and the terminal parts of the other halved flat tube 5*a* are folded back in a size enough to wrap in the outer surface of the terminal part of the aforementioned halved flat tube 5*b*. Here, the folded parts constitute themselves the inserting parts 62*a*, 62*b* for insertion into the engaging holes 60 and the terminal surfaces of the folded flange parts constitute themselves the abutting parts 61*a*, 61*b* for contact with the peripheral edges of the engaging holes 60. When the two halved flat tubes 5*a*, 5*b* are soldered within the furnace in the state joined and the flat tubes 5 are attached to the header pipes 1, 2, the inserting parts 62*a*, 62*b* in the terminal parts of the flat tube 5 are inserted into the header pipes 1, 2 until the abutting parts 61*a*, 61*b* collide against the peripheral edges of the engaging holes.

Also in this arrangement, the sizes of the engaging holes allowed for insertion are fixed in consequence of the positioning of the abutting parts. As the result, the work of assemblage is facilitated to a great extent.

The embodiments described above are desired to be used mainly for condensers in automobile air conditioners. This invention is not limited to this particular use but may be used for evaporators or for automobile radiators.

As described above, this invention contemplates imparting a zigzagged flow to the heat-exchanger fluid in motion inside the flat tube by means of baffle members and further defining the cross-sectional area of the flow paths to an equivalent diameter in the range of 0.4 to 1.5 mm and consequently ensures thorough stirring of the refrigerant without entailing any appreciable addition to the resistance of the flow paths to the fluid in motion. The heat exchanger, therefore, is enabled to enjoy a notable improvement in the heat exchange efficiency.

As regards the formation of the baffle members, the fact is that the baffle members are formed as integral parts of the flat tube itself allows a decrease in the number of component parts and consequent facilitation of the manufacture of the heat exchanger and proves to be advantageous from the economic point of view.

Further, since this invention contemplates causing one-side ends of the header pipes of the heat exchanger to be inserted into engagement with an object intended as a base for attachment through the medium of elastic members and, at the same time, the other-side ends of the header pipes to be attached to the object with retaining brackets as accessorial parts through the medium of elastic members, the work of attaching the heat exchanger to the object can be carried out very easily and the possible errors of manufacture can be absorbed.

The apexes of the dimples in the two halved flat tubes are joined in a width in the range of 1 to 2 mm. These dimples are spaced with a prescribed pitch in the range of 2 to 4 mm. The inside thickness of the flat tube is selected in the range of 0.5 to 1.7 mm. Owing to the incorporation of these dimples, the flat tube has no use for the inner fin. Thus, the flat tube of this configuration obviates the necessity for the step of inserting the inner fin into the flat tube and the step of crushing the flat tube after the insertion of the inner fin. It also precludes the possible clogging of the flat tube due to the improvement in the work of application of the flux. The heat exchanger enjoys high heat exchange capacity and is easy to manufacture.

One flat tube is obtained by joining two halved flat tubes. In the terminal parts of the halved flat tubes, there are formed abutting parts conforming to the peripheral edges of the engaging holes in the header pipes. Thus, the work of positioning the flat tubes is easy to carry out and the work of assemblage is performed with enhanced efficiency.

What is claimed is:

1. In an automobile air conditioner, a multi-flow type condenser comprising:

a. an inlet header pipe for admitting an air conditioner heat-exchange fluid in at least partly vapor form;

b. an outlet header pipe for discharging said air conditioner heat-exchange fluid in at least partly liquid form, said outlet header pipe being disposed parallel to and separated from said inlet header pipe by a prescribed length; and c. a plurality of flat tubes disposed parallel to one another, and disposed between said inlet header pipe and said outlet header pipe so that one end of said flat tube is disposed adjacent said inlet header tube, and an opposite end of said flat tube is disposed adjacent said outlet header pipe, wherein said flat tubes further comprise (i) a plurality of small flow paths which impart a zigzagging stirring motion to said heat-exchange fluid, said flow paths being defined by a plurality of dimples which project symmetrically toward each other so as to partition the flow path inside of said flat tubes, said dimples having apexes joined to each other in a width in the range of 1 to 2 mm, said dimples being spaced with a fixed pitch (Pd) in the range of 2 to 4 mm, and the inside thickness (t) of said tubes being in the range of 0.5 to 1.7 mm, and wherein said flow paths have an equivalent diameter in the range of 0.4 to 1.5 mm.

2. A multi-flow type automobile air conditioner condenser as claimed in claim 1, wherein said flat tubes are formed by deforming terminal flanges of a flat sheet material form having dimples preformed therein toward each other, and adjoining said terminal flanges by welding.

3. A multi-flow type automobile air conditioner condenser as claimed in claim 1, wherein said equivalent diameter is about 0.7 mm.

4. A multi-flow type automobile air conditioner condenser as claimed in claim 1, further comprising corrugated fins disposed between said plurality of parallel flat tubes and disposed between said inlet header pipe and said outlet header pipe, and wherein said corrugated fins are integrally joined to said flat tubes by soldering.

5. A multi-flow type automobile air conditioner condenser as claimed in claim 1, wherein the ends of said flat tubes are inserted in said inlet header pipe and said outlet header pipe and welded together.

6. A multi-flow type automobile air conditioner condenser as claimed in claim 1, wherein the ends of said flat tubes have abutting parts adapted to make close contact with said inlet header pipe and said outlet header pipe so that said flat tubes and said inlet header pipe and outlet header pipe are held in intimate contact with each other while they are welded together.

7. A multi-flow type automobile air conditioner condenser as claimed in claim 1, wherein the ends of said flat tubes are provided with (i) inserting parts conforming in shape to engaging holes present in said inlet header pipe and said outlet header pipe, and (ii) abutting parts conforming to peripheral edges present on said engaging holes.

8. A multi-flow type automobile air conditioner condenser as claimed in claim 1, wherein one-side ends of said header pipes are fastened to engaging parts formed in an object serving as a base for attachment and the other-side ends of said header pipes are attached to said object through retaining brackets adapted to retain in place said other-side ends.

9. A multi-flow type automobile air conditioner condenser as claimed in claim 8, wherein elastic members are interposed between the one-side ends of said header pipes and said engaging parts of said object, and between said retaining brackets and the other-side ends of said header pipes.

10. In an automobile air conditioner, a multi-flow type condenser comprising:

a. an inlet header pipe for admitting an air conditioner heat-exchange fluid in at least partly vapor form and for discharging air conditioner fluid in at least partly liquid form;

b. an inlet tube connected to said inlet header pipe in the upper portion of said inlet header pipe in the vertical direction thereof;

c. an outlet tube connected to said inlet header pipe in the lower portion of said inlet header pipe in the vertical direction thereof;

d. a partition plate disposed at the center of said inlet header pipe in the vertical direction thereof and disposed between said inlet tube and said outlet tube;

e. an outlet header pipe disposed parallel to and separated from said inlet header pipe by a prescribed length; and f. a plurality of flat tubes disposed parallel to one another, and disposed between said inlet header pipe and said outlet header pipe so that one end of said flat tube is disposed adjacent said inlet header pipe, and an opposite end of said flat tube is disposed adjacent said outlet header pipe, wherein said flat tubes further comprise (i) a plurality of small flow paths which impart a zigzagging stirring motion to said heat-exchange fluid, said flow paths being defined by a plurality of dimples which project symmetrically toward each other so as to partition the flow path inside of said flat tubes, said dimples having apexes joined to each other in a width in the range of 1 to 2 mm, said dimples being spaced with a fixed pitch (Pd) in the range of 2 to 4 mm, and the inside thickness (t) of said tubes being in the range of 0.5 to 1.7 mm, and wherein said flow paths have an equivalent diameter in the range of 0.4 to 1.5 mm.

11. A multi-flow type automobile air conditioner condenser as claimed in claim 10, wherein said flat tubes are formed by deforming terminal flanges of a flat sheet material form having dimples preformed therein toward each other, and adjoining said terminal flanges by welding.

12. A multi-flow type automobile air conditioner condenser as claimed in claim 10, further comprising corrugated fins disposed between said plurality of parallel flat tubes and disposed between said inlet header pipe and said outlet header pipe, and wherein said corrugated fins are integrally joined to said flat tubes by soldering.

13. A multi-flow type automobile air conditioner condenser as claimed in claim 10, wherein the ends of said flat tubes are inserted in said inlet header pipe and said outlet header pipe and welded together.

14. A multi-flow type automobile air conditioner condenser as claimed in claim 12, wherein the ends of said flat tubes have abutting parts adapted to make close contact with said inlet header pipe and said outlet header pipe so that said flat tubes and said inlet header pipe and outlet header pipe are held in intimate contact with each other while they are welded together.

15. A multi-flow type automobile air conditioner condenser as claimed in claim 10, wherein the ends of said flat tubes are provided with (i) inserting parts conforming in shape to engaging holes present in said inlet header pipe and said outlet header pipe, and (ii) abutting parts conforming to peripheral edges present on said engaging holes.

16. A multi-flow type automobile air conditioner condenser as claimed in claim 10, wherein one-side ends of said inlet header pipe and said outlet header pipe are fastened to engaging parts formed in an object serving as a base for attachment and the other-side ends of said inlet header pipe and said outlet header pipe are attached to said object through retaining brackets adapted to retain in place said other-side ends.

17. A multi-flow type automobile air conditioner condenser as claimed in claim 16, wherein elastic members are interposed between the one-side ends of said inlet header pipe and said outlet header pipe and said engaging parts of said object, and between said retaining brackets and the other-side ends of said inlet header pipe and said outlet header pipe.

18. In an automobile air conditioner, a multi-flow type condenser comprising:

a first header pipe;

b. a second header pipe disposed parallel to and separated from said first header pipe by a prescribed length; and c. a plurality of flat tubes, each allowing passage of a flow of heat-exchange fluid, disposed parallel to one another, and disposed between said first header pipe and said second header pipe so that each of said flat tubes has one end disposed adjacent said first header pipe and an opposite end disposed adjacent said second header pipe, wherein each of said flat tubes further comprises (i) a plurality of flow paths which impart a zigzagging stirring motion to said flow of heat-exchange fluid, said flow paths being defined by a plurality of dimples which project symmetrically toward each other so as to partition said flow of heat-exchange fluid inside of said flat tube, said dimples having apexes joined to each other, said dimples being spaced with a fixed pitch (Pd) in the range of 2 to 4 mm, the inside thickness (t) of said tubes being in the range of 0.5 to 1.7 mm, and wherein said flow paths have an equivalent diameter in the range of 0.4 to 1.5 mm.

19. In an automobile air conditioner, a multi-flow type condenser comprising:

a first header pipe;

a second header pipe disposed parallel to and separated from said first header pipe by a prescribed length;

a plurality of flat tubes, each allowing passage of a flow of heat exchange fluid, disposed parallel to one another, and disposed between said first header pipe and said second header pipe so that each of said flat tubes has one end disposed adjacent said first header pipe and an opposite end disposed adjacent said second header pipe; and a partition plate disposed in said first header pipe to divide said first header pipe into a first and second section;

wherein each of said flat tubes comprises a plurality of flow paths which impart a zigzagging stirring motion to said flow of heat-exchange fluid, said flow paths being defined by a plurality of dimples which project symmetrically toward each other so as to partition said flow of heat-exchange fluid inside of said flat tube, said dimples having apexes joined to each other, said dimples being spaced with a fixed pitch (Pd), and the inside thickness (t) of said tubes being in the range of 0.5 to 1.7 mm, and wherein said flow paths have an equivalent diameter in the range of 0.41 to 1.5 mm.

20. A multi-flow type automobile air conditioner as claimed in claim 19, wherein said fixed pitch is in the range of 2 to 4 mm.

21. A multi-flow type automobile air conditioner condenser as claimed in claim 20, wherein said first section of said first header pipe is disposed above said second section of said first header pipe.

22. A multi-flow type automobile air conditioner as claimed in claim 21, further comprising:

an inlet tube connected to said first header pipe in communication with said first section of said first header pipe; and an outlet tube connected to said first header pipe in communication with said second section of said first header pipe.

23. A tube for allowing passage of a flow of air conditioner heat-exchange fluid therethrough in a longitudinal direction thereof, comprising:

first and second walls extending in the longitudinal direction and spaced from each other;

third and fourth parallel walls extending in the longitudinal direction and interconnected by said first and second walls to define in cooperation with said first and second walls a space extending in the longitudinal direction;

a plurality of first dimples projecting into said space from said third wall; and a plurality of second dimples projecting into said space from said fourth wall, said plurality of second dimples projecting toward said plurality of first dimples and joined thereto, respectively, at apexes thereof, to define within said space a plurality of flow paths which impart a zigzagging stirring motion to the flow of heat-exchange fluid, wherein said plurality of first dimples are spaced with a predetermined pitch within the range of 2 to 4 mm, said plurality of second dimples being spaced with said predetermined pitch, said third and fourth parallel walls being spaced at a distance within the range of from 0.5 to 1.7 mm, and wherein each of said flow paths has an equivalent diameter in the range of 0.4 to 1.5 mm.

24. A tube as claimed in claim 23, wherein each of said plurality of second dimples is joined to one of said plurality of first dimples with a predetermined width extending transversely with respect to the longitudinal direction.

25. A tube as claimed in claim 24, wherein said predetermined width falls in the range of 1 to 2 mm.

* * * * *